US007988255B2

(12) United States Patent
Balcan et al.

(10) Patent No.: US 7,988,255 B2
(45) Date of Patent: Aug. 2, 2011

(54) FULL FUNCTION MAINTENANCE STATION

(75) Inventors: Petrica D. Balcan, San Diego, CA (US); Wayne E. Stiehler, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 601 days.

(21) Appl. No.: 11/969,265

(22) Filed: Jan. 4, 2008

(65) Prior Publication Data

US 2009/0174748 A1 Jul. 9, 2009

(51) Int. Cl.
*B41J 2/165* (2006.01)

(52) U.S. Cl. ..... 347/32

(58) Field of Classification Search ..... None
See application file for complete search history.

(56) References Cited

U.S. PATENT DOCUMENTS

| | | | | |
|---|---|---|---|---|
| 5,257,044 | A | 10/1993 | Carlotta et al. | |
| 5,831,644 | A | 11/1998 | Kato | |
| 5,917,516 | A | 6/1999 | Nguyen et al. | |
| 5,971,520 | A | 10/1999 | Nakahara | |
| 6,309,044 | B1 | 10/2001 | Gaarder | |
| 6,328,412 | B1 * | 12/2001 | Taylor et al. | 347/32 |
| 6,340,219 | B1 * | 1/2002 | Kumagai et al. | 347/33 |
| 6,540,320 | B2 | 4/2003 | Ng | |
| 6,702,424 | B2 | 3/2004 | Takahashi | |
| 6,846,060 | B2 | 1/2005 | Waller et al. | |
| 6,890,055 | B2 * | 5/2005 | Schalk et al. | 347/32 |
| 6,991,312 | B2 | 1/2006 | Uwagaki et al. | |
| 7,225,697 | B2 | 6/2007 | Schalk et al. | |
| 2004/0212656 | A1 | 10/2004 | Waller et al. | |
| 2005/0179713 | A1 | 8/2005 | Waller et al. | |
| 2006/0268089 | A1 * | 11/2006 | Takeuchi | 347/104 |
| 2007/0103504 | A1 | 5/2007 | Huang | |

* cited by examiner

*Primary Examiner* — Matthew Luu
*Assistant Examiner* — Alejandro Valencia
(74) *Attorney, Agent, or Firm* — William R. Zimmerli; David A. Novais; Eugene I. Shkurko

(57) ABSTRACT

An apparatus and method of operating a maintenance station in a printer are provided. The method includes providing a feed roller shaft including an end, the feed roller shaft being connected to a motor; providing a maintenance station disposed near the end of the feed roller shaft, the maintenance station comprising a first pinion; a second pinion; and a maintenance sled including a rack with the rack including teeth positioned along a length dimension of the rack to provide a travel path for the maintenance sled; and using the motor that is connected to the feed roller shaft to cause the maintenance sled to travel back and forth along the travel path by separately engaging the first and second pinions, respectively, with the rack teeth.

18 Claims, 20 Drawing Sheets

FULL FUNCTION MAINTENANCE STATION

FIELD OF THE INVENTION

The invention relates generally to the field of inkjet printers, and in particular to a maintenance station for maintaining the jetting performance of an inkjet printhead of the inkjet printer.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink chamber, an ejecting actuator and an orifice through which droplets of ink are ejected. The ejecting actuator can be one of various types, including a heater that vaporizes some of the ink in the chamber in order to propel a droplet out of the orifice, or a piezoelectric device which changes the wall geometry of the chamber in order to generate a pressure wave that ejects a droplet. The droplets are typically directed toward paper or other print medium (sometimes generically referred to as paper herein) in order to produce an image according to image data that is converted into electronic firing pulses for the drop ejectors as the print medium is moved relative to the printhead.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath. In order to accomplish the motions necessary for printing in a carriage printer, there are typically at least two motors—the motor for print medium advance, and the motor for carriage motion. The examples described in the present invention relate to a carriage printer architecture.

Inkjet ink includes a variety of volatile and nonvolatile components including pigments or dyes, humectants, image durability enhancers, and carriers or solvents. A key consideration in ink formulation is the ability to produce high quality images on the print medium. During periods when ink is not being ejected from an ejector, the volatile components of the ink can evaporate through the nozzle, or there can be other factors why the ink properties (such as viscosity) at the nozzle can change. Such changes can make the drop ejection process nonuniform, so that the image quality can be degraded. In addition, dust, dried ink or other particulates can partially block a nozzle or make the wettability of the nozzle face around the nozzle nonuniform so that ejected drops can be misdirected from their intended flight paths.

In order to maintain the drop ejecting quality of the printhead so that high quality images are produced even after periods where one or more nozzles has been inactive, a variety of maintenance actions have been developed and are well known in the art. These maintenance actions can include capping the printhead nozzle face region during periods of nonprinting, wiping the nozzle face, periodically spitting drops from the nozzles into the cap or other reservoir that is outside the printing region, priming the nozzles by applying a suction pressure at the nozzle face, etc. In addition, in order to remove excess ink from the cap due to spitting or priming, it can be useful to pump the waste ink into a waste pad region where it can accumulate and dry over the lifetime of the printer. Although a separate motor can be used to perform one or more of the maintenance functions, low cost designs typically perform maintenance functions using the motor for print medium advance or the motor for carriage scanning. However, it can be difficult to provide the full range of maintenance functions without a separate motor. At the same time, as the requirements for high quality and long lasting images continue to be extended, a low cost design of a full function maintenance station is needed.

Motions which are typically involved for various maintenance operations can include motions of the cap, the wipers and a pump. When the printhead is done printing, the carriage is typically moved to a "home position" which is located outside the printing region. The cap is located at or near the home position, but when the carriage moves into the home position, there is a gap between the cap and the printhead face so that the two do not collide and do damage to one another. When the carriage is located in the home position, the cap is typically moved into a confronting position with the nozzle face. When the carriage gets ready to leave the home position in order for the printhead to print, the cap must again be moved away from the nozzle face.

The motion of the wiper(s) depends on whether wiping has been designed to occur along the nozzle array direction or across the nozzle array direction. FIG. 1 shows the nozzle face 252 of a printhead die 251. In this example, there are three nozzle arrays 253 that are aligned along nozzle array direction 254 and that are spaced apart from one another along a direction perpendicular to the nozzle array direction. The nozzle arrays 253 are each staggered so that the nozzle in an array are not aligned in a single line along direction 254, but rather in two lines. Typically, the nozzles of the top nozzle array in this example might eject ink of one color (such as cyan), while the nozzles of the middle nozzle array might eject ink of a second color (such as magenta), and the nozzles of the bottom nozzle array might eject ink of a third color (such as yellow). Along the nozzle array direction 254 in this direction for a given array, are disposed nozzles to eject ink of a single type. Also shown in FIG. 1 are wirebond interconnections 255 to connect electrical pads on printhead die 251 with pads at the ends of leads 259 on flex circuit 257. The wire bonds are coated with an encapsulant 256.

A perspective view of the printhead die 251 of FIG. 1 is shown in FIG. 2. The die 252 and the flex circuit 257 are mounted on supporting substrate 261. In FIG. 2, a wiper blade 112 is shown moving along nozzle array direction 254 in order to wipe away a pool of ink 270. The wiper blade can actually move the pool of ink 270 over the mound of encapsulant 256. An advantage of wiping along the nozzle array direction is that there is less likelihood of cross-contamination between the different fluids in the different nozzle arrays 253. Many printers are designed such that wiping occurs across the nozzle arrays, i.e. the respective motion between the wiper blade and the nozzle face is perpendicular to nozzle array direction 254. One reason that this is done is that the wiper blade 112 can be held in a stationary position toward the end of carriage travel and the nozzle face 252 simply brought past the wiper blade by the motion of the carriage.

As is well known in the art, the nozzle array direction 254 in a carriage printer must be substantially perpendicular to the carriage motion direction, in order to print the image. Also note that the length of the wiper blade 112 should be substantially perpendicular to the relative motion of the wiper blade 112 and the nozzle face 252. Therefore, if the relative motion of the wiper blade 112 and the nozzle face 252 is accomplished by carriage motion, the length of the wiper blade will be along nozzle direction 254, and wiping will occur from one nozzle array to the next. Examples of such systems that wipe perpendicular to the nozzle array direction are provided in U.S. Pat. No. 5,257,044, U.S. Pat. No. 5,831,644, U.S. Pat. No. 5,917,516, U.S. Pat. No. 5,971,520, U.S. Pat. No. 6,309,044, U.S. Pat. No. 6,540,320, and U.S. Pat. No. 6,991,312. In such systems, it can still be necessary to move the wipers from a retracted position to a position such that the blade can contact the nozzle face, but as wiping is occurring, the blade typically remains fixed.

On the other hand, if the wiping is to be done along the nozzle array direction, then the wipers cannot remain in a fixed position while the carriage moves the nozzle face past. Rather the wipers must be actively moved in order to wipe along the nozzle array direction. Examples of wipers that are moved along the nozzle array direction are provided in U.S. Pat. No. 6,702,424, U.S. Pat. No. 6,846,060 and U.S. Pat. No. 7,225,697.

Motion in a mechanical pump is also typically actuated in an inkjet system. This is done in order to provide a suction force in order to prime the printhead when needed, and also can be done in order to empty waste ink out of the cap. Typically, priming is done at a time when the cap is sealed up against the nozzle face of the printhead, while cap emptying is done when the cap is separated from the printhead. In many printers the type of pump that is used is a tube pump.

It can be appreciated that it is desirable to control some of the maintenance operations independently of the others. For example, it is not necessary to prime the printhead every time the printhead is capped. Furthermore, the duration of priming can need to be customized according to the ink used (i.e. different ink viscosities), the nozzle size, the environmental conditions, or the time since the last printing operation, for example. In addition it is not necessary to empty waste ink from the cap every time the cap is moved away from the nozzle face. It can also not be necessary to cap after every wiping operation. In much of the prior art, maintenance operation has its timing determined by mechanical components such as gears and cams in order to sequence the operations.

There is a need in a low cost inkjet printer for a maintenance station that a) does not require an additional motor; b) is able to perform the full set of maintenance operations of capping, wiping, priming and emptying the cap; and c) allows at least some of the maintenance operations to be controlled independently—such as whether or not to pump and how long to pump to accommodate different printhead types, different ink types, or different operating conditions, for example.

SUMMARY OF THE INVENTION

According to one feature of the present invention, a printer includes a feed roller shaft and a maintenance station. The feed roller shaft includes an end. The maintenance station is disposed near the end of the feed roller shaft and comprises a first pinion; a second pinion; and a maintenance sled including a rack. The rack includes teeth positioned along a length dimension of the rack to provide a travel path for the maintenance sled. The first and second pinions are separately engageable with the rack teeth such that the maintenance sled travels back and forth, respectively, along the travel path.

According to another feature of the present invention, a method of operating a maintenance station in a printer includes providing a feed roller shaft including an end, the feed roller shaft being connected to a motor; providing a maintenance station disposed near the end of the feed roller shaft, the maintenance station comprising a first pinion; a second pinion; and a maintenance sled including a rack with the rack including teeth positioned along a length dimension of the rack to provide a travel path for the maintenance sled; and using the motor that is connected to the feed roller shaft to cause the maintenance sled to travel back and forth along the travel path by separately engaging the first and second pinions, respectively, with the rack teeth.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
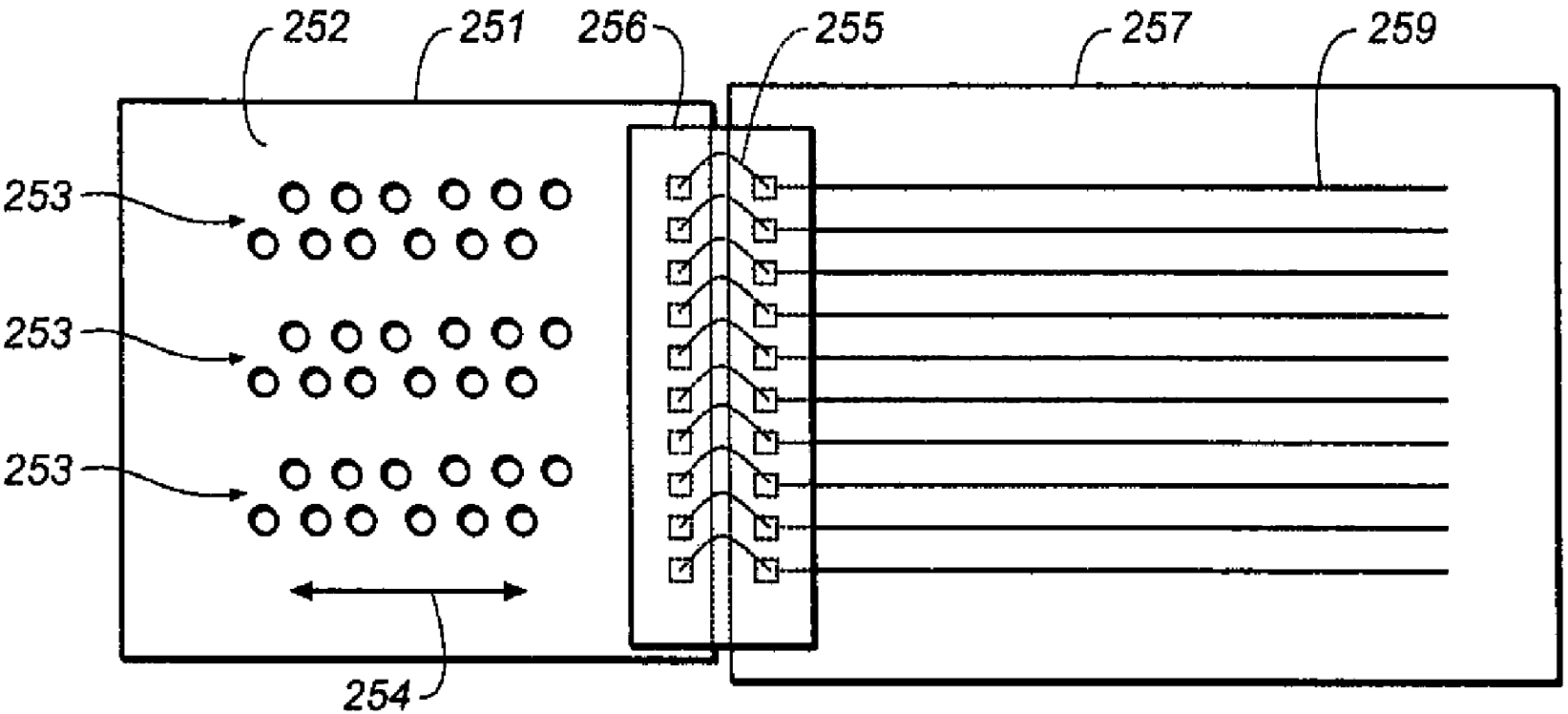
FIG. 1 is a top view of a nozzle face of a printhead.
Figure 2:
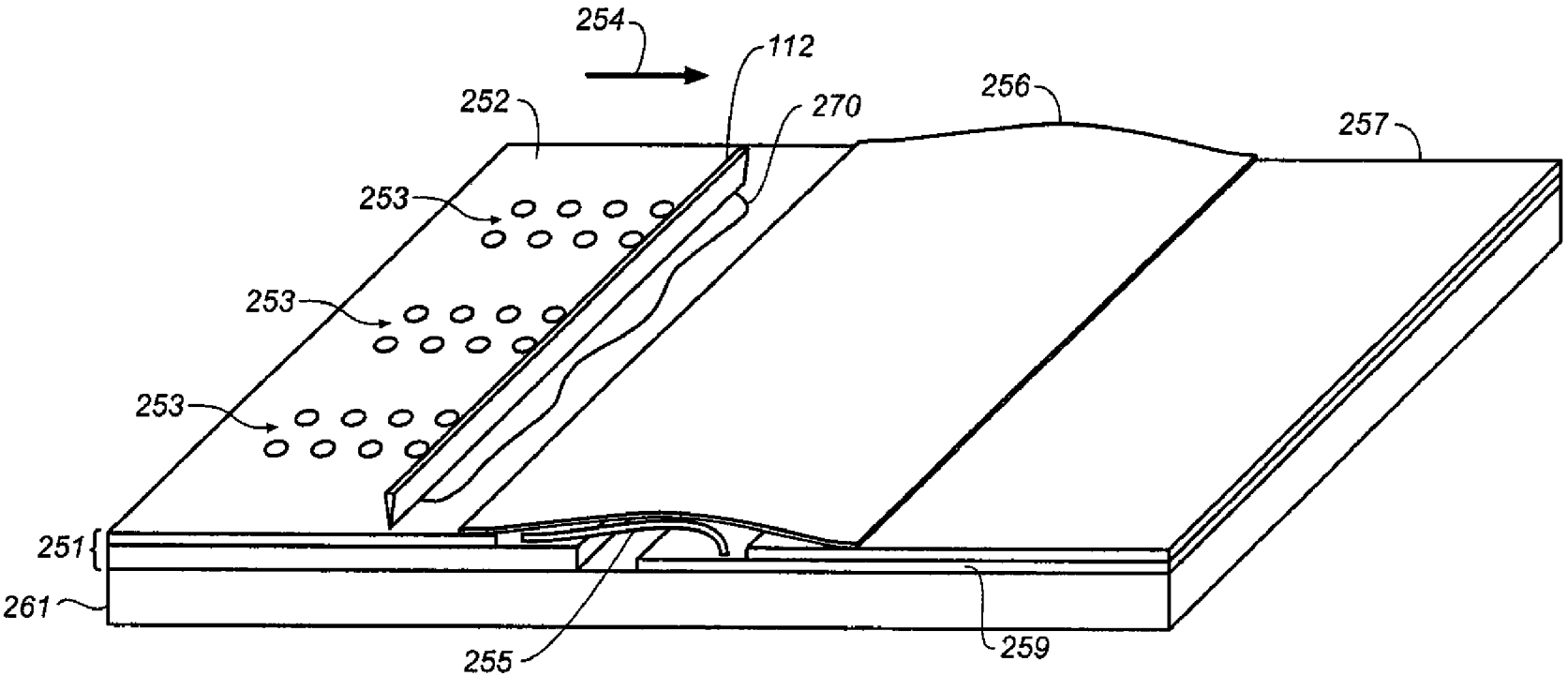
FIG. 2 is a perspective illustration of a wiper blade wiping a pool of ink along the nozzle array direction.

The present description will be directed in particular to elements forming part of, or cooperating more directly with, apparatus in accordance with the present invention. It is to be understood that elements not specifically shown or described can take various forms well known to those skilled in the art.

In the following description, directional terminology such as front, rear, left, right, top, bottom, etc. is used with reference to the orientation of the figure being described or to the orientation of a component when it is located in its normal operating position in the example being described. As components of the embodiments of the present invention can be positioned in a number of different orientations, the directional terminology is used for purposes of illustration and is in no way limiting. To facilitate understanding, identical reference numerals have been used, where possible, to designate identical elements that are common to the figures.

Figure 3:
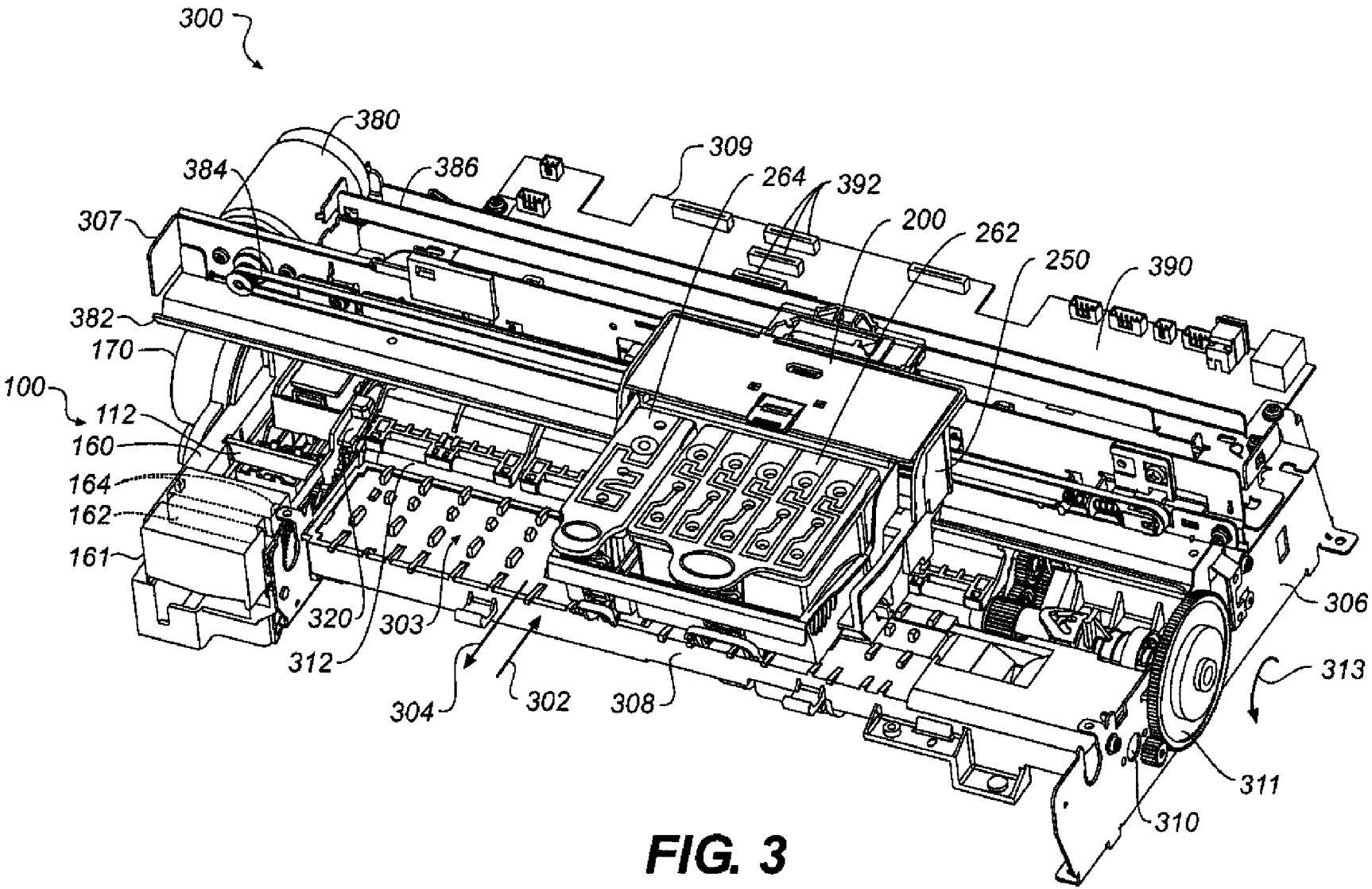
FIG. 3 is a perspective illustration of a printer including an embodiment of the present invention.

FIG. 3 shows a portion of a carriage printer that includes an embodiment of the present invention. Some of the parts of the printer have been hidden in the view shown in FIG. 3 so that other parts can be more clearly seen. Printer chassis 300 has a print region 303 across which carriage 200 is moved back and forth between the right side 306 and the left side 307 of printer chassis 300 while printing. Carriage motor 380 moves belt 384 to move carriage 200 back and forth along carriage guide rail 382. Printhead chassis 250 is mounted in carriage 200, and ink supplies 262 and 264 are mounted in the printhead chassis 250. Paper, or other print medium (not shown) is loaded along paper load entry direction 302 toward the front 308 of printer chassis 300. A variety of rollers are used to advance the medium through the printer. In the example of FIG. 3, a pickup roller (not shown) moves paper in the direction of arrow 302. A turn roller (not shown) toward the rear 309 of the printer chassis 300 acts to move the paper around a C-shaped path so that the paper continues to advance along direction arrow 304 from the rear 309 of the printer. The paper is then moved by feed roller 312 to advance across print region 303, and from there to a discharge roller (not shown), so that printed paper exits along direction 304. Feed roller 312 includes a feed roller shaft along its axis (the shaft being parallel to carriage guide rail 384), and feed roller gear 311 is mounted on the feed roller shaft. The motor that powers the paper advance rollers is not shown in FIG. 3, but the hole 310 at the right side 306 of the printer chassis 300 is where the motor gear (not shown) protrudes through in order to engage feed roller gear 311. Toward the left side 307 in the example of FIG. 3 (and near the end of the feed roller 312 that is opposite the end where feed roller gear 311 is mounted) is the maintenance station 100 which includes a movable maintenance sled 130 (shown more clearly in FIGS. 7 and 8), a stationary maintenance station frame 160 that surrounds sled 130, a wiper 112, a wiper scraper box 161, a wiper scraper 162, a forward stop 164, a tube pump 170, and other components to be described below with reference to other figures. Note in particular that wiper blade 112 is oriented parallel to the shaft of feed roller 312. Such an orientation of the wiper blade relative to the feed roller is characteristic of carriage printers in which the wiper blade wipes the nozzle face along the nozzle array direction. Toward the rear 309 of the printer in this example is located the electronics board 390, which contains cable connectors 392 for communicating via cables (not shown) to the printhead carriage 200 and from there to the printhead. Also on the electronics board are typically mounted a motor controllers for the carriage motor 380 and for the paper advance motor, a processor and/or other control electronics for controlling the printing process, and an optional connector for a cable to a host computer.

Figure 4:
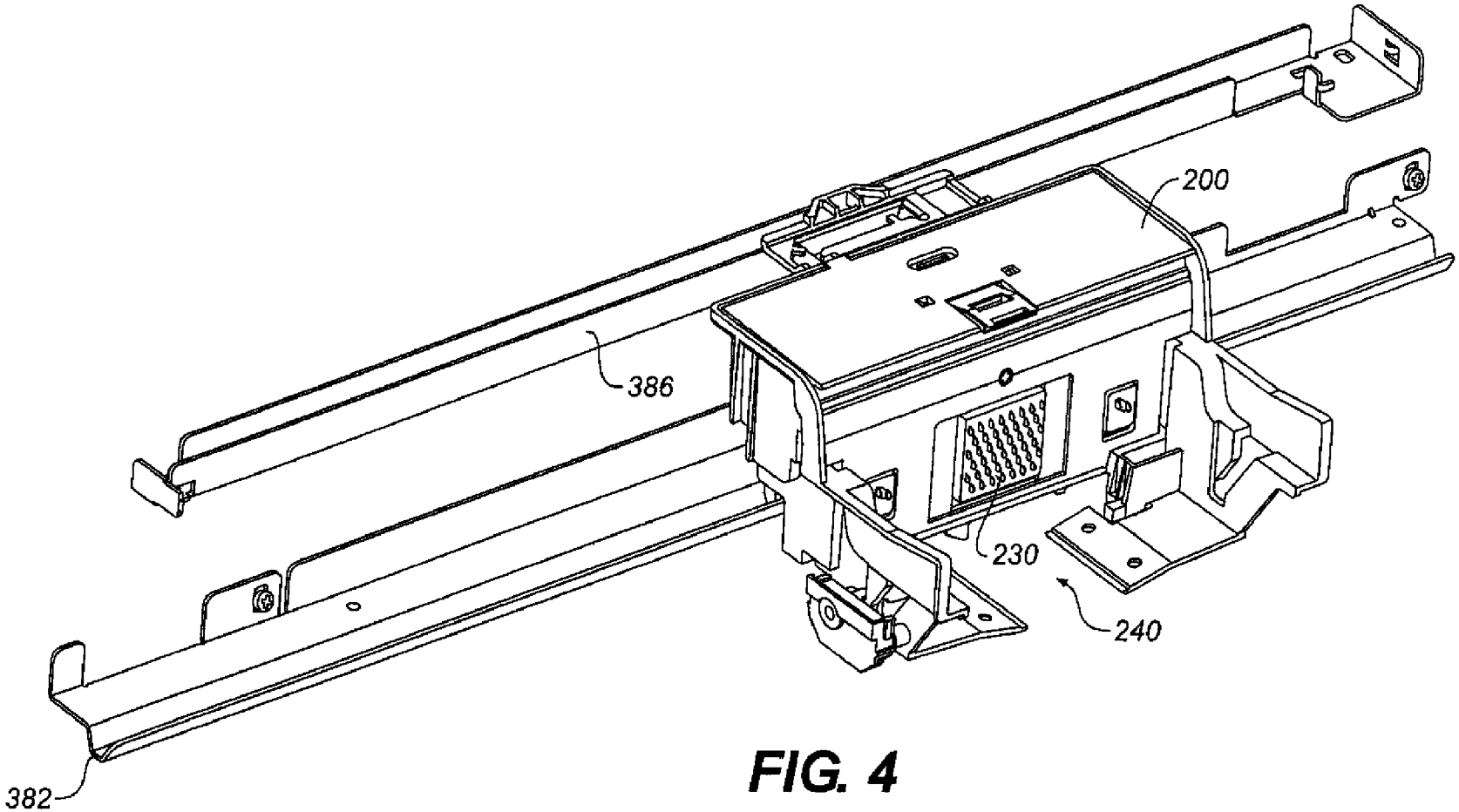
FIG. 4 is a perspective illustration of the carriage and guide rail for the printer shown in FIG. 3.

FIG. 4 is a perspective view of the carriage 200, the carriage rail 382, a rotation limiting rail 386, a carriage electrical connector 230, and a carriage print zone region 240. One or more portions of carriage 200 are in contact with carriage rail 382, so that carriage rail 382 keeps the carriage and the printhead (not shown in FIG. 4) at a constant distance from the paper or other print medium. Another portion of the carriage 200 is in contact with anti-rotation rail 386 in order to keep the plane of the carriage and printhead in a substantially constant orientation. When the printhead is mounted in the carriage 200, the nozzle arrays (not shown in FIG. 4) are located in the print zone region 240 of cartridge 200.

Figure 5:
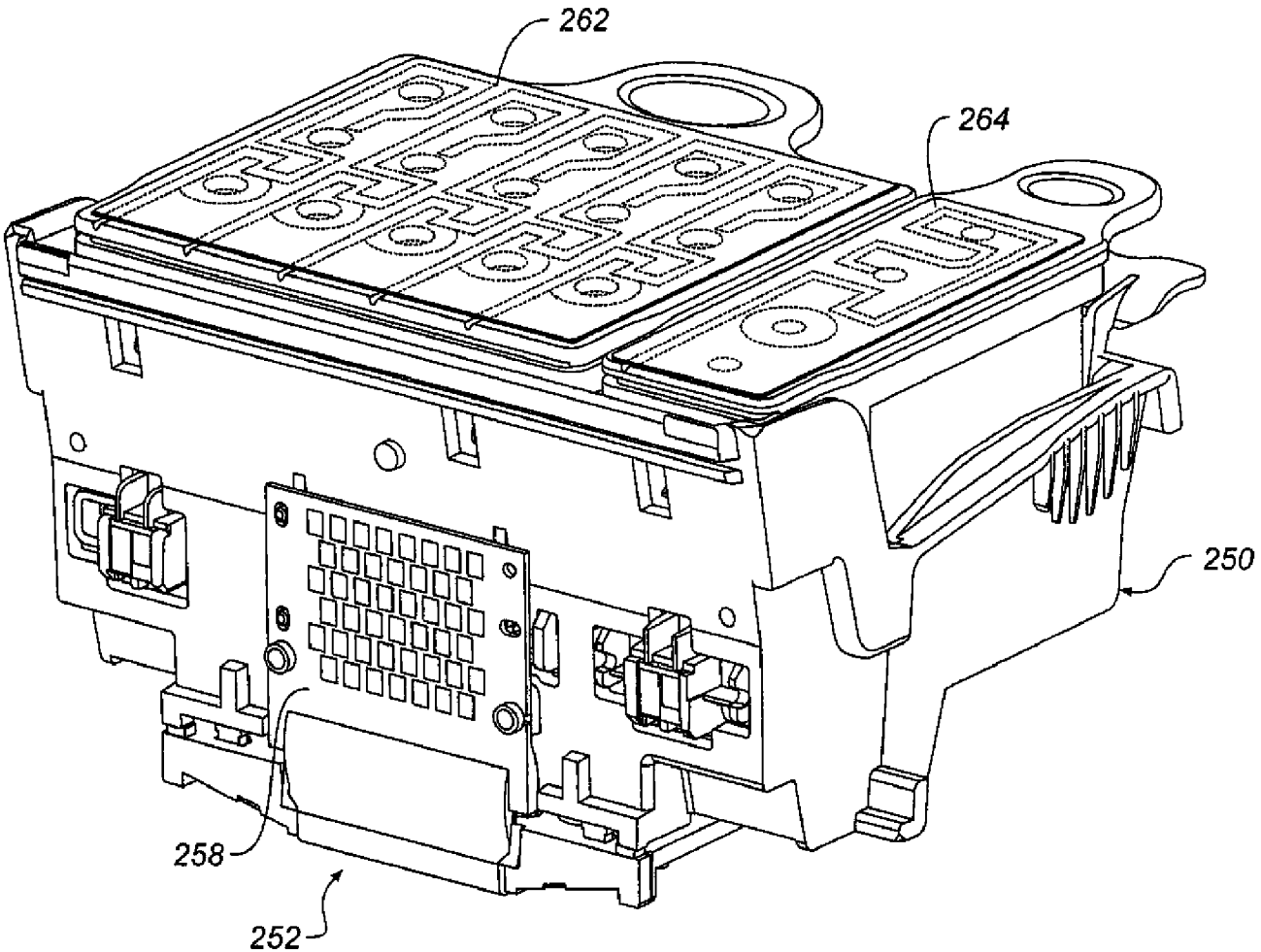
FIG. 5 is a perspective illustration of a printhead that can be mounted in the carriage shown in FIG. 4.
Figure 6:
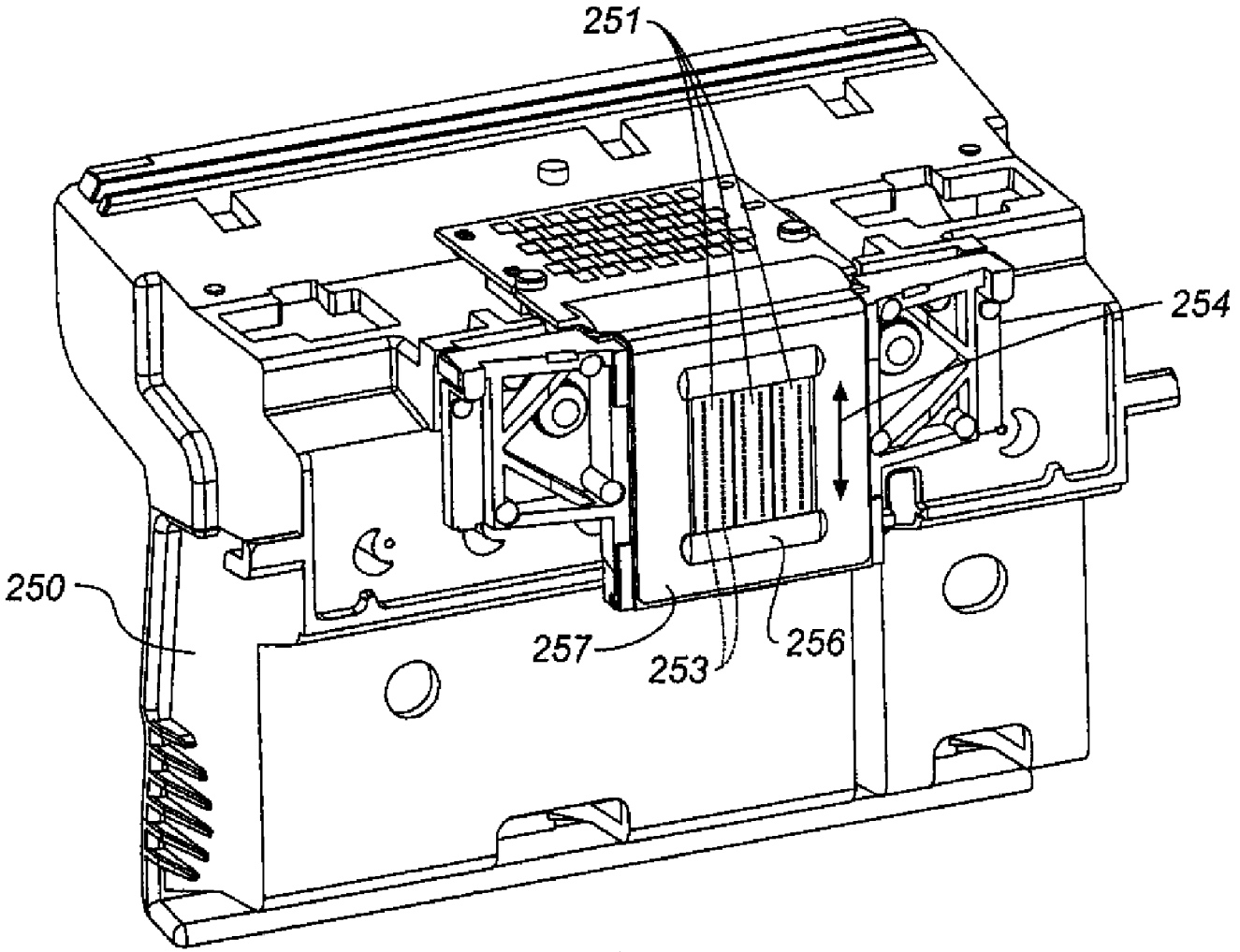
FIG. 6 is a perspective illustration of the nozzle region of the printhead that is shown in FIG. 5.

In the example described herein, the nozzles are above the print medium in print region 303, so that the nozzles point downward when the printhead is mounted in the carriage in the printer, and the printer is oriented in its typical orientation on a horizontal surface. FIGS. 5 and 6 show two different orientations of printhead chassis 250 and its associated components. In FIG. 5 the printhead is oriented with the printhead nozzle face 252 (not shown) pointing downward. Mounted in the printhead chassis 250 are a multichamber ink supply 262 and a single chamber ink supply 264. Also shown in FIG. 5 is the printhead electrical connector 258 that mates with the carriage electrical connector 230 when the printhead chassis 250 is mounted in the carriage 200.

The view shown in FIG. 6 is rotated from that in FIG. 5 and shows the bottom side of printhead chassis 250. Three printhead die 251 are shown in this example, where each printhead die 251 includes two nozzle arrays 253, and all six nozzle arrays 253 are along nozzle array direction 254. The printhead die 253 are each interconnected to flex circuit 257, which in turn is connected to printhead electrical connector 258. Encapsulation 256 (at each end of the three printhead die 251 in the example of FIG. 6) covers the interconnections between the die 251 and the flex circuit 257.

Figure 7:
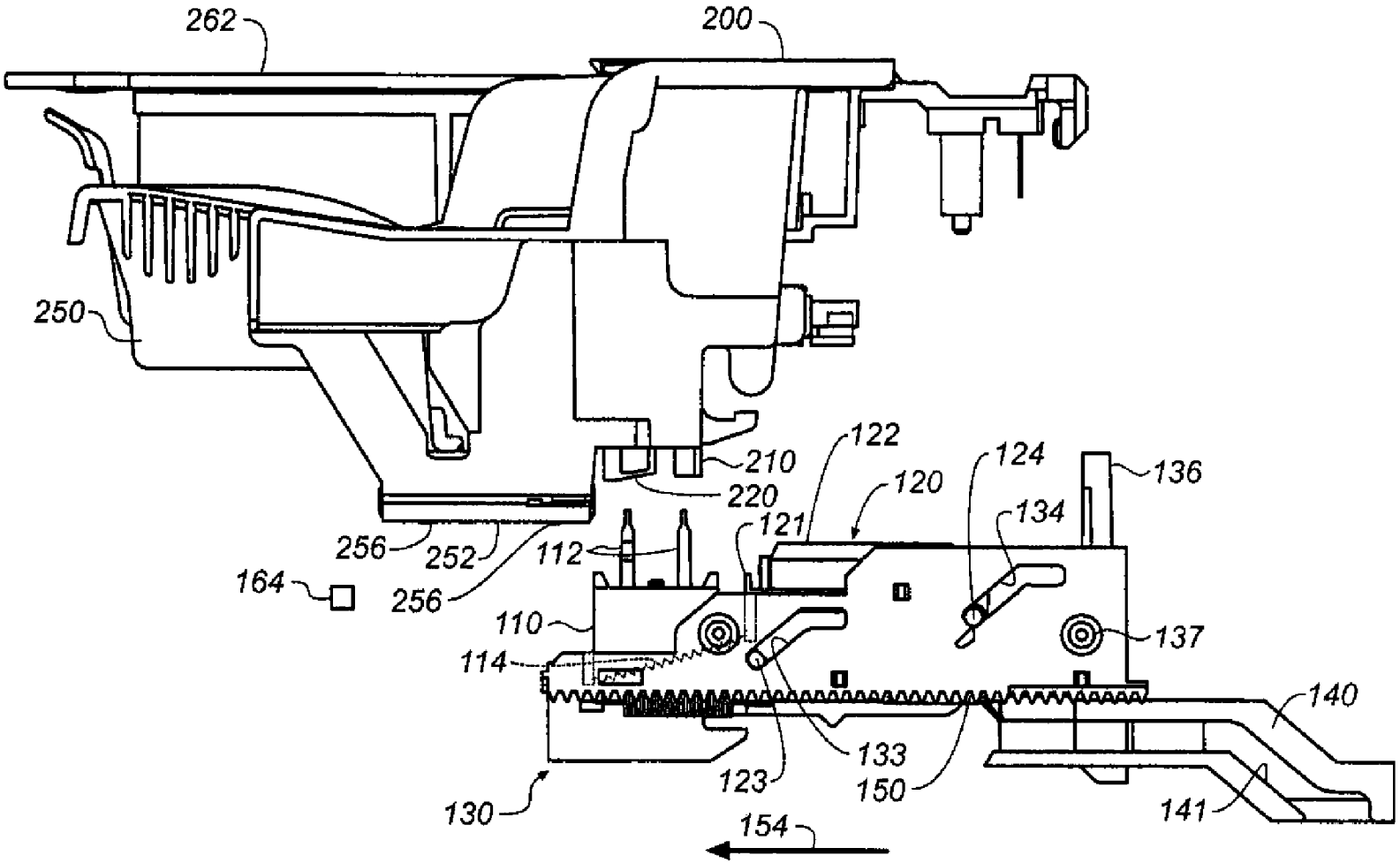
FIG. 7 is a right side view of the carriage and an embodiment of the maintenance sled of the present invention.
Figure 8:
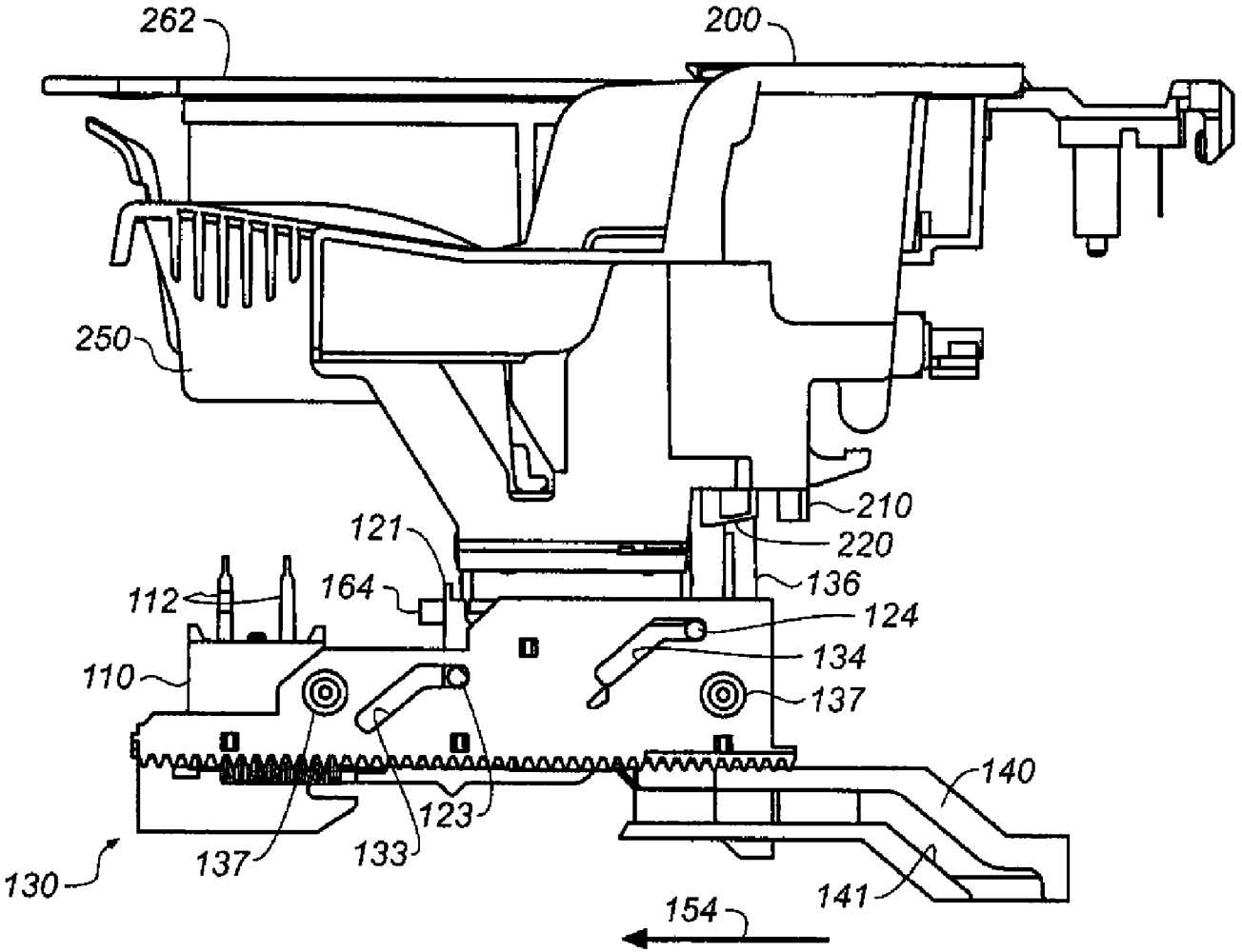
FIG. 8 is a right side view of an embodiment the maintenance sled of the present invention in which the maintenance sled has moved into capping position.

FIG. 7 shows a side view of the printhead chassis 250 and the maintenance sled 130 when they are located in a configuration for printing, while FIG. 8 shows a similar side view when the printhead chassis 250 has arrived at the home position and the nozzle face 252 is capped by cap assembly 120. Maintenance sled 130 is located between nozzle face 252 and the rear 309 of the printer chassis in FIG. 7, but has moved forward along direction 154 toward the front 308 of the printer chassis in FIG. 8. FIGS. 7 and 8 show several features of this embodiment of maintenance sled 130, but maintenance station frame 160 is mostly hidden so that the other features can be seen more clearly.

Flexible wiper blades 112 are mounted on wiper blade platform 110. In this example, wiper blade platform 110 is fixedly attached to maintenance sled 130, so that it moves forward along a path in direction 154 as the sled 130 moves forward. Direction 154 is perpendicular to the orientation of wiper blade(s) 112, i.e. direction 154 is perpendicular to the shaft of feed roller 312. As the wiper blades 112 move forward, they encounter printhead nozzle face 252 and wipe along the nozzle array direction 254, which is parallel to direction 154. Cap assembly 120 is movably mounted on maintenance sled 130, and includes cap support platform 121, cap sealing service 122, cap platform front pin(s) 123, and cap platform rear pin(s) 124. Maintenance sled 130 includes inclined slot(s) 133 for front pin(s) 123 of cap platform 121, as well as inclined slot(s) 134 for rear pin(s) 134 of cap platform 121. One end of spring 114 is attached to the front of cap platform 121 and the other end is attached to a front portion of maintenance sled 130. Maintenance sled 130 also includes guide pin 137, which guides the motion of maintenance sled 130 relative to maintenance station frame 160, and also includes carriage latch feature 136, which serves to lock the carriage 200 in the home position when engaged with carriage latch extension 220 on the carriage, as in FIG. 8. Maintenance sled 130 further includes sled rack 150, the configuration and operation of which are described in more detail below.

While maintenance station frame 160 is mostly hidden in FIGS. 7 and 8, forward stop 164, which extends inwardly from the side(s) of maintenance station frame 160 is shown. As maintenance sled 130 is moved forward along direction 154, wiper blade platform 110 is narrow enough to pass without hitting forward stop 164. However, cap support platform 121 is sufficiently wide that it hits forward stop 164 as the maintenance sled 130 moves forward to a position where the cap support platform is directly below printhead nozzle face 252. As maintenance sled 130 continues to move forward along direction 154, cap support platform 121 is restricted by forward stop 164 from moving further forward. As a result, cap support platform 121 moves upward, being guided by pins 123 and 124 in inclined slots 133 and 134 (inclined upward relative to path direction 154), until sealing surface 122 of cap assembly 120 is sealed against the printhead face. Cap support platform 121 moves upward in a direction that is perpendicular to the shaft of feed roller 312 and also perpendicular to direction 154. While cap support platform 121 is restricted from moving forward, but maintenance sled 130 continues to move forward, spring 114 becomes stretched, providing a restoring force between cap support platform 121 and maintenance sled 130. Also seen in FIGS. 7 and 8 is sled extension 140 including ramped slot 141. Sled extension 140 and slot 141 do not have a maintenance-related function, but rather a paper handling function to be described below.

Figure 9:
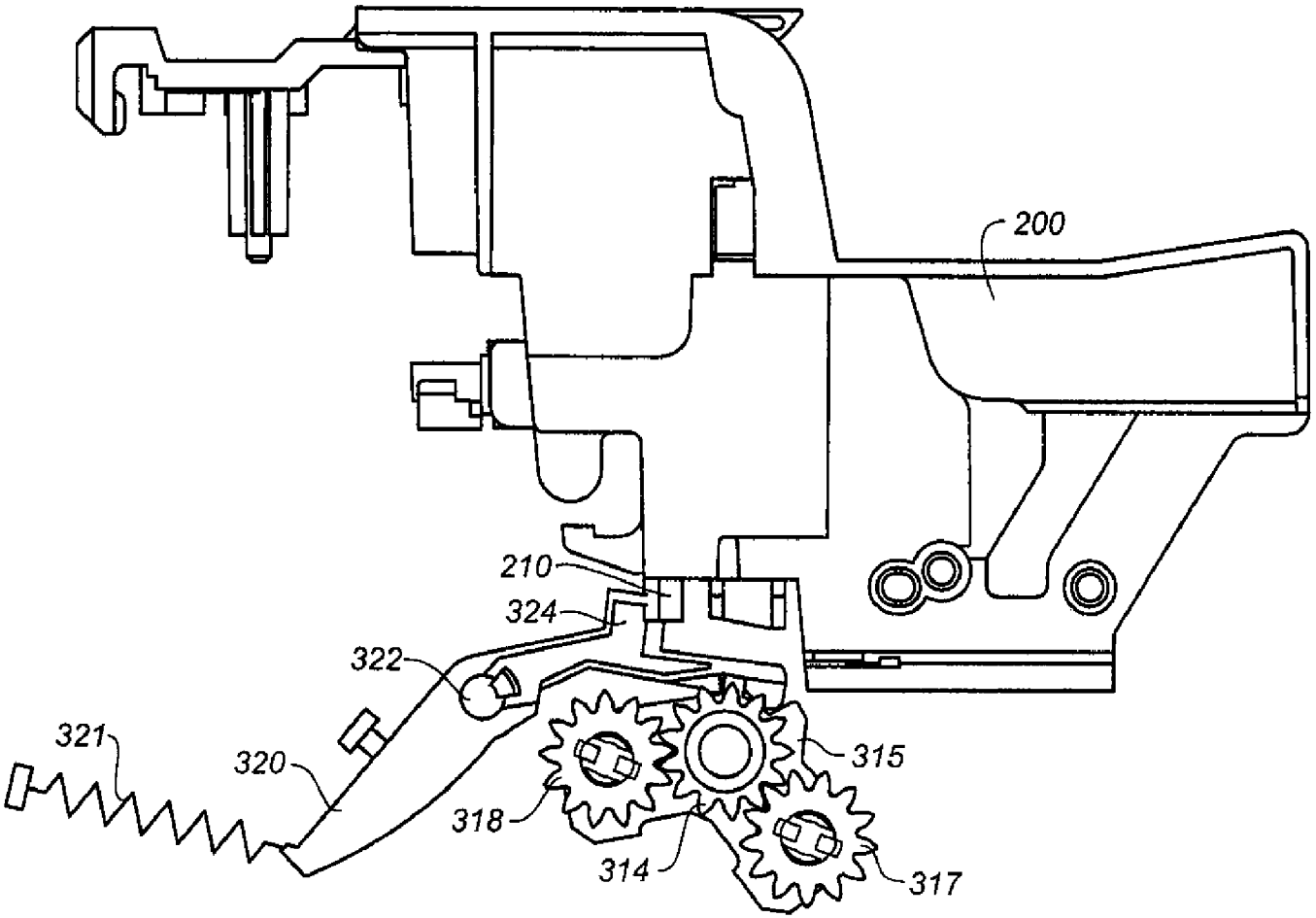
FIG. 9 is a left side view of the carriage and an embodiment of a clutch arm of the present invention.
Figure 10:
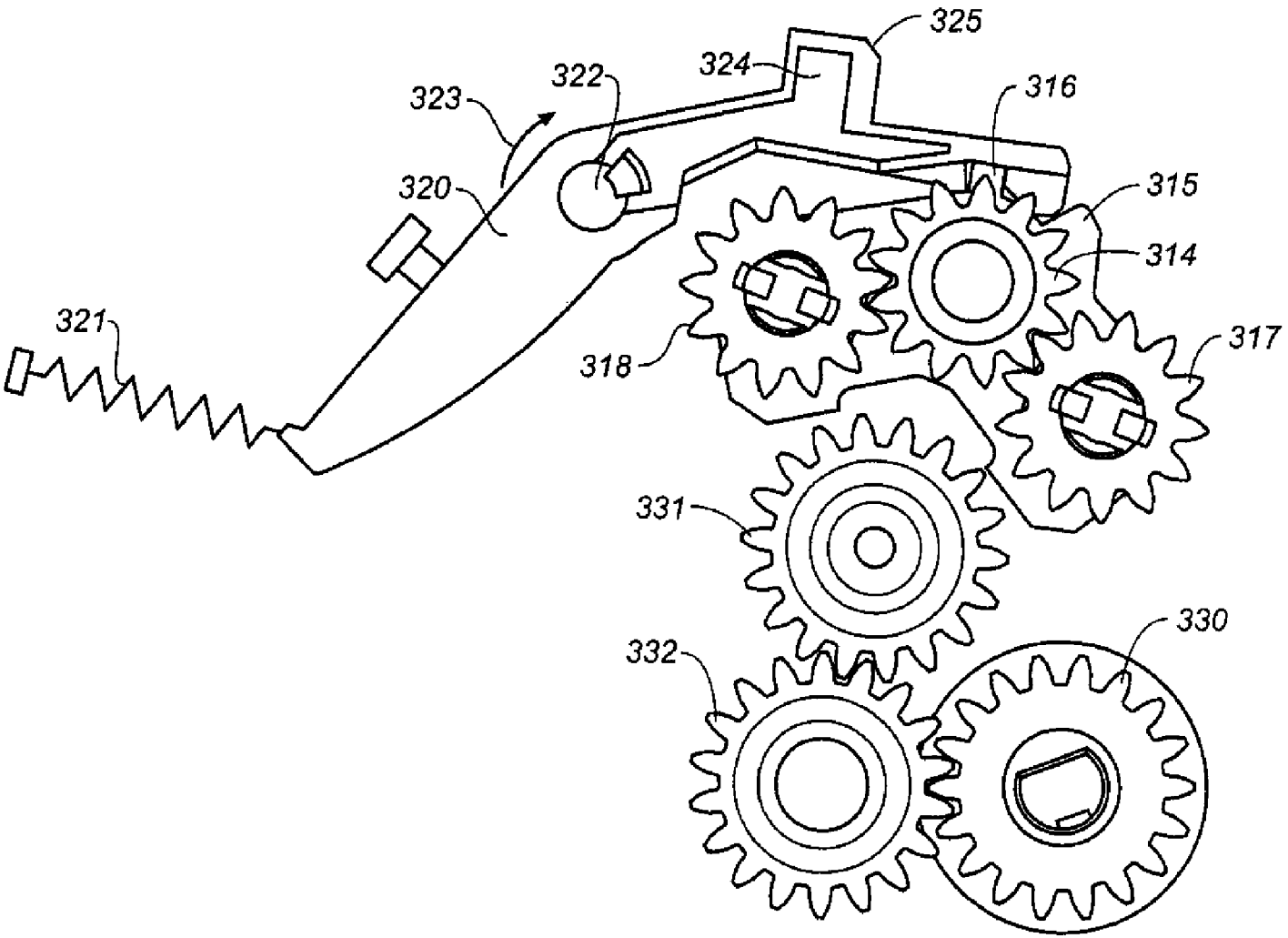
FIG. 10 is a left side view of the clutch arm of FIG. 9 in a latching configuration relative to gears on a pivot arm.
Figure 11:
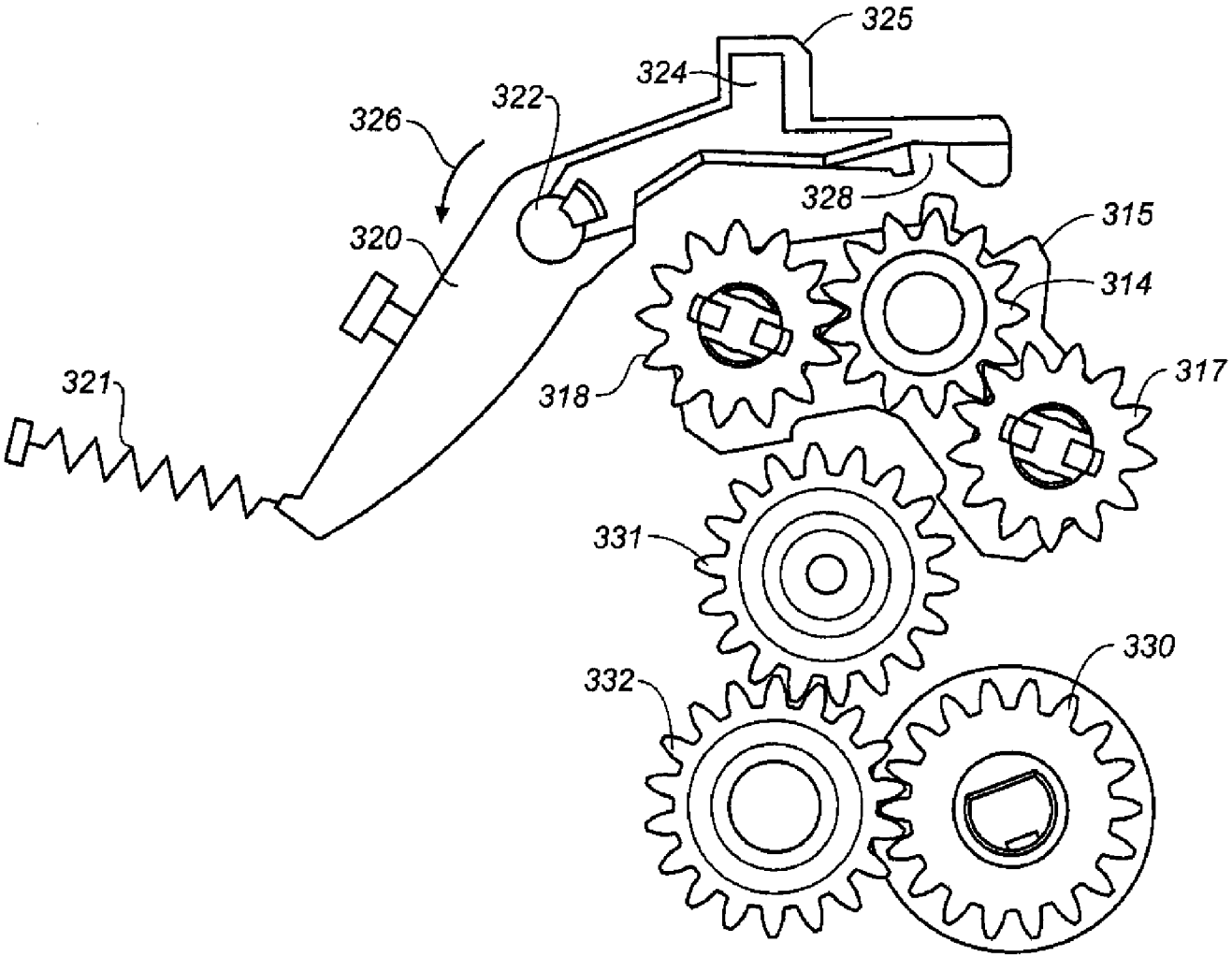
FIG. 11 is a left side view of the clutch arm of FIG. 9 in an unlatched configuration.

Motion of the maintenance sled 130 and its associated parts should be enabled when the printhead chassis 250 is located in the home position, but should be disabled when the printhead chassis 250 and carriage 200 are being moved along carriage guide rail 382. FIGS. 9, 10 and 11 illustrate how the enabling and disabling takes place in this example. Latching clutch arm 320 is located near maintenance station 100, as seen in FIG. 3. Latching clutch arm 320 has an extension 324 which is hit by clutch pusher 210 of carriage 200 when carriage 200 moves into the home position above maintenance station 100. Latching clutch arm 320 is rotatably mounted on mounting pin 322 and is biased by spring 321 such that clutch arm 320 tends to rotate in direction 323 about mounting pin 322, thereby causing latching notch 328 in clutch arm 320 to engage with latching tab 316 on latching pivot arm 315.

As shown in FIG. 10, when latching notch 328 is engaged with latching tab 316, neither first gear 317 nor second gear 318 on pivot arm 315 can rotate into engagement with pivot arm receiving gear 331. However, when the carriage 200 moves into the home position so that clutch pusher 210 hits beveled surface 325 on extension 324 of clutch arm 320, clutch arm 320 is caused to rotate in direction 326, as seen in FIG. 11, and latching notch 328 is disengaged from latching tab 316. This unlatched configuration will be preserved as long as carriage 200 is in the home position and clutch pusher 210 is pushing clutch arm extension 324. When carriage 200 exits the home position, spring 321 will cause clutch arm 320 to rotate in direction 323 so that pivot arm 315 is latched again. Feed roller pinion 314, which is mounted coaxially on the shaft of feed roller 312, is engaged with both first gear 317 and second gear 318 on pivot arm 315.

When the carriage 200 is in the home position so that latching clutch arm 320 is unlatched as in FIG. 11, the direction of rotation of feed roller 312 will determine the direction of rotation of pivot arm 315, and therefore whether first gear 317 or second gear 318 becomes engaged with pivot arm receiving gear 331. If first gear 317 is engaged, gear 331 will rotate in one direction and if second gear 318 is engaged, gear 331 will rotate in the opposite direction. Thus pivot arm receiving gear 331, which transfers power to the maintenance station if engaged by gears 317 or 318, receives its power as well as its direction of rotation from the turning of feed roller 312, which is in turn powered by the print medium advance motor. Pivot arm receiving gear 331 is mounted on the outside of maintenance station frame 160, as are sled frame idler gear 332 and sled drive gear 330 in this embodiment.

Figure 12:
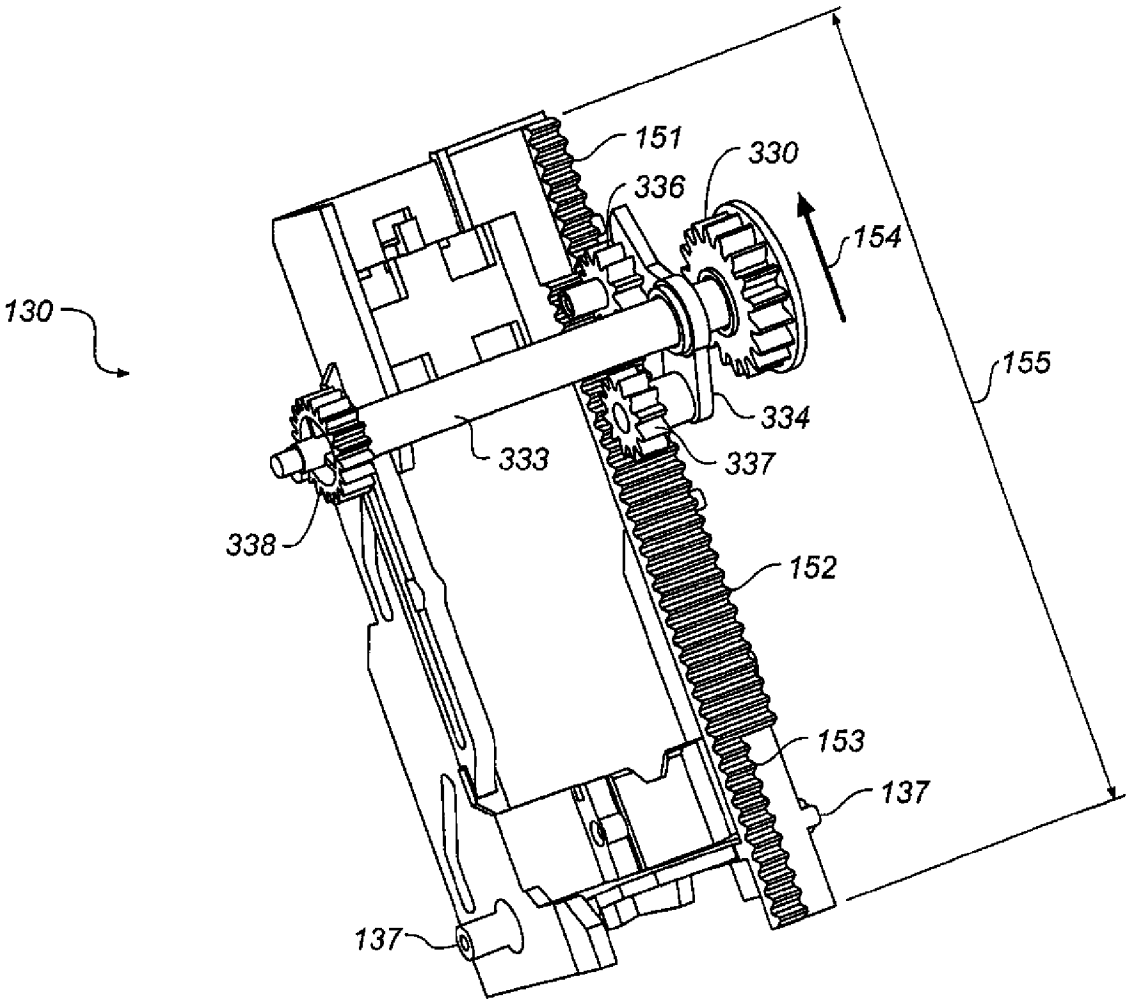
FIG. 12 is a bottom perspective view of an embodiment of the maintenance sled of the present invention.

FIG. 12 shows a bottom perspective view of maintenance sled 130, and in particular sled rack 150 whose design and operation are features of the present invention that help to enable a full range of maintenance operations with independent control at low cost. Sled rack 150 has rack teeth positioned along length dimension 155, which is along the direction of sled motion 154 and is therefore perpendicular to the shaft of feed roller 312. The positioning and the width of the rack teeth depend on the region of the rack that the tooth is located in. In the middle region 152 of sled rack 150, the rack teeth extend across the rack region. In the first end region 151 of sled rack 150, the rack teeth are located toward one edge of maintenance sled 130, and the rack teeth only extend a portion of the way across the rack region, when compared to middle region 152. In the second end region 153 of sled rack 150, the rack teeth are located away from the edge of the maintenance sled, and the rack teeth only extend a portion of the way across the rack region, when compared to middle region 152. Our terminology for such a rack configuration is an offset rack. First pinion 336 and second pinion 337 which are offset from one another along the direction of the axis of sled drive shaft 333 are also shown in FIG. 12. Because of the offset of the two pinions, first pinion 336 can engage rack teeth in first end region 151 and middle region 152 of rack 150, but not in second end region 153. In addition, second pinion 337 can engage rack teeth in second end region 153 and middle region 152 of rack 150, but not in first end region 151. The rack teeth in first end region 151 are offset from the rack teeth in second end region 153 in a direction that is parallel to the shaft of feed roller 312. Similarly, first pinion 336 is offset from second pinion 337 in a direction that is parallel to the shaft of feed roller 312.

Figure 13:
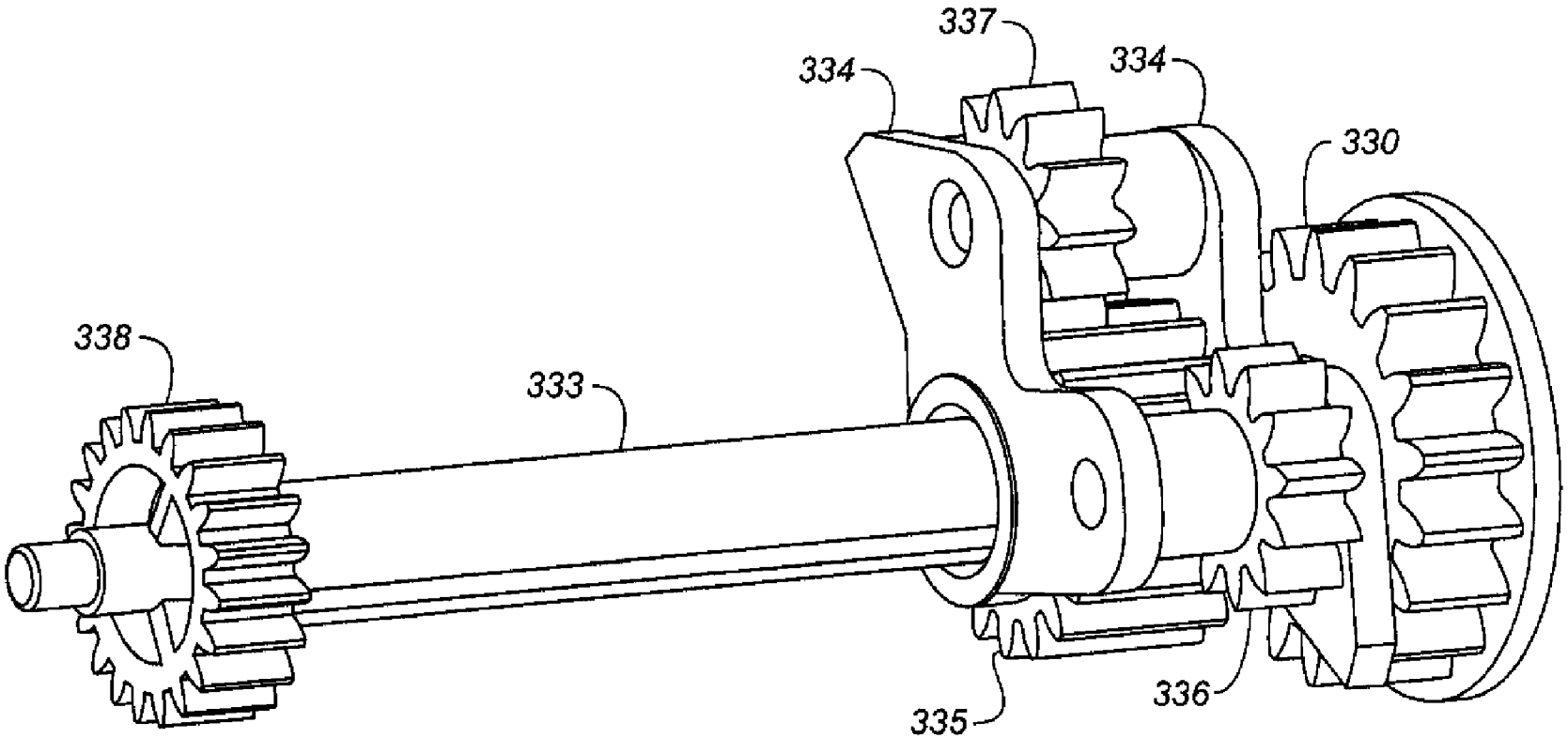
FIG. 13 is a perspective view of an embodiment of the sled drive shaft for the maintenance sled of the present invention.
Figure 14:
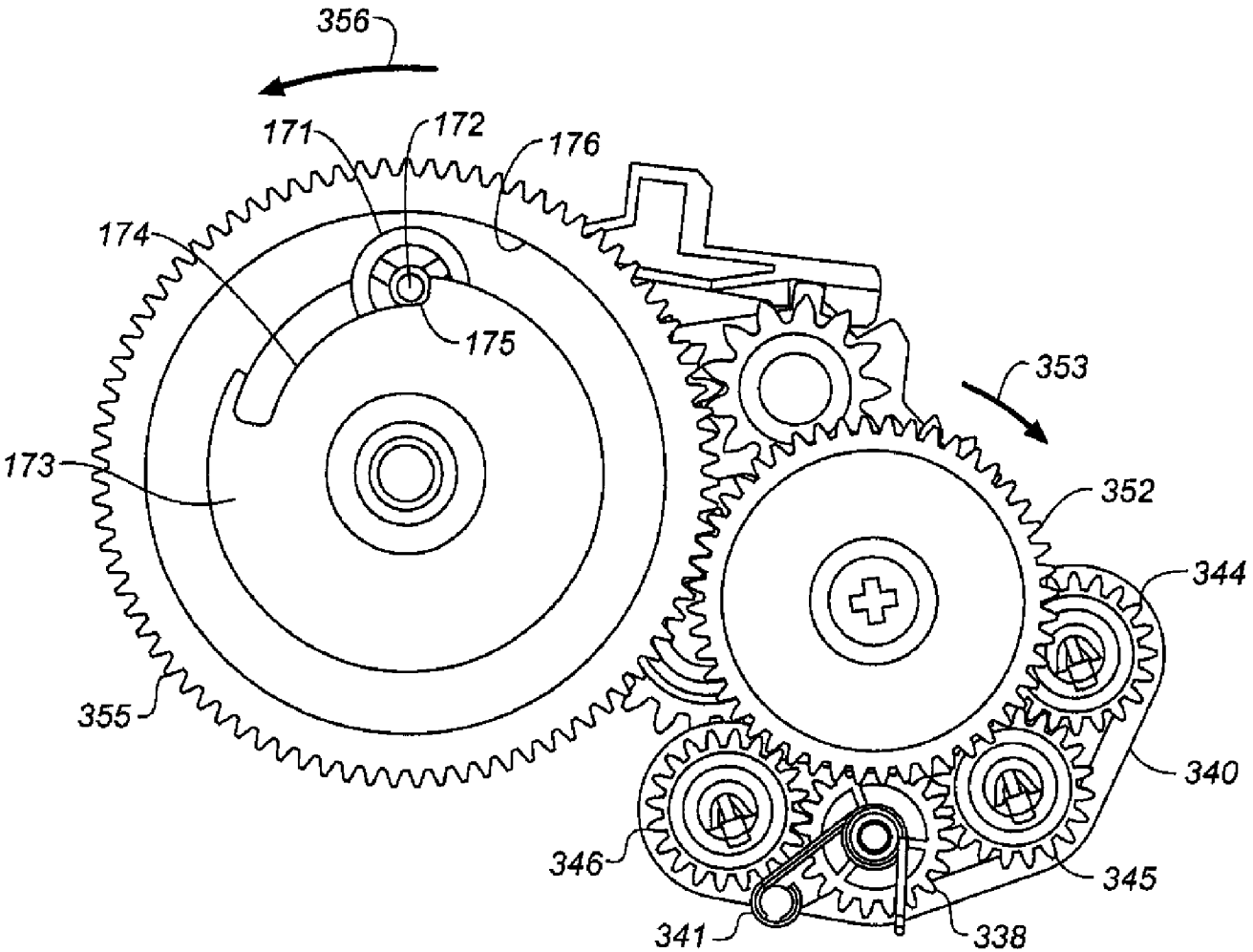
FIG. 14 is a left side view of an embodiment of the pump and associated gears of the present invention.
Figure 15:
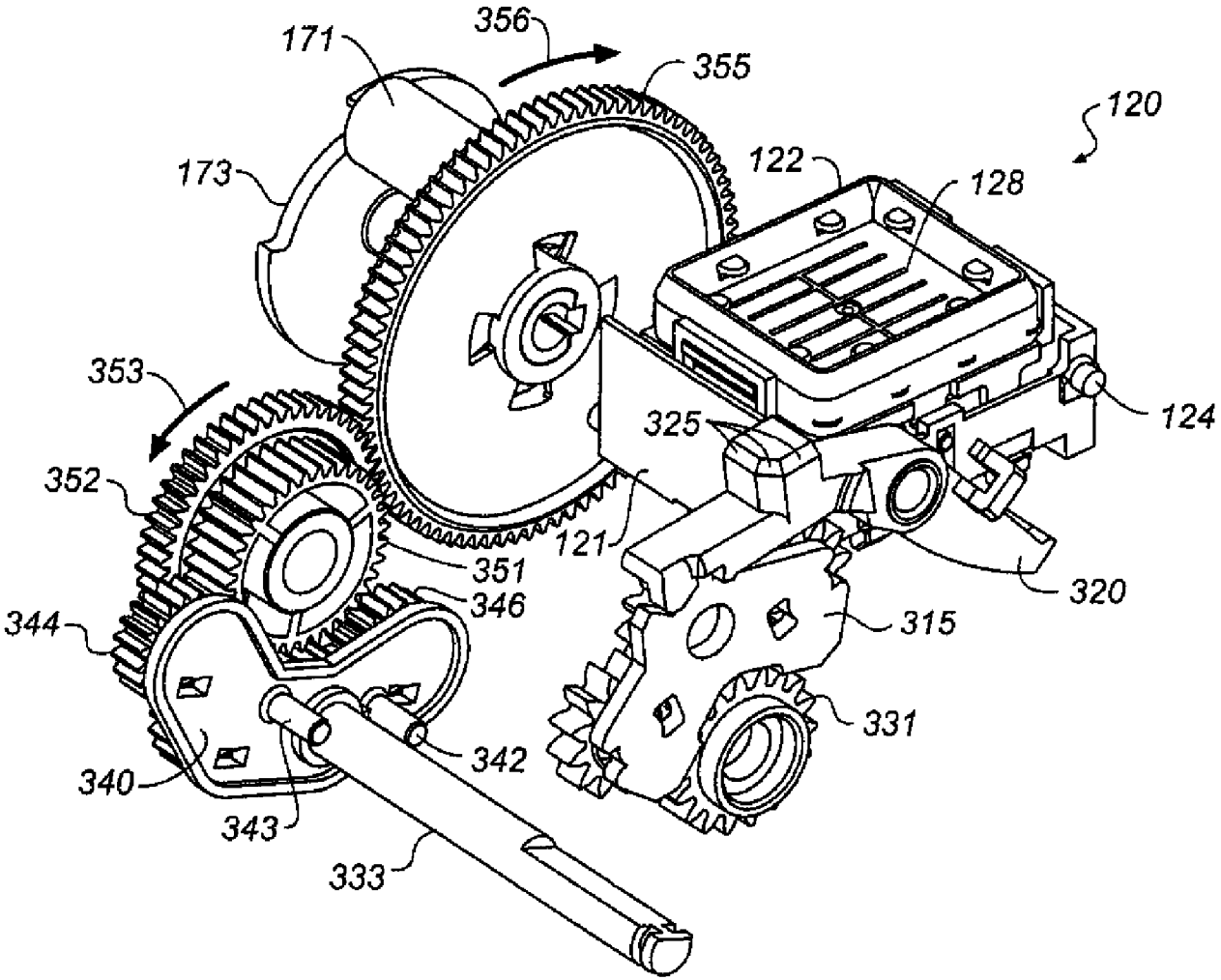
FIG. 15 is a perspective view of an embodiment of the cap assembly and the pump with associated gears.
Figure 16:
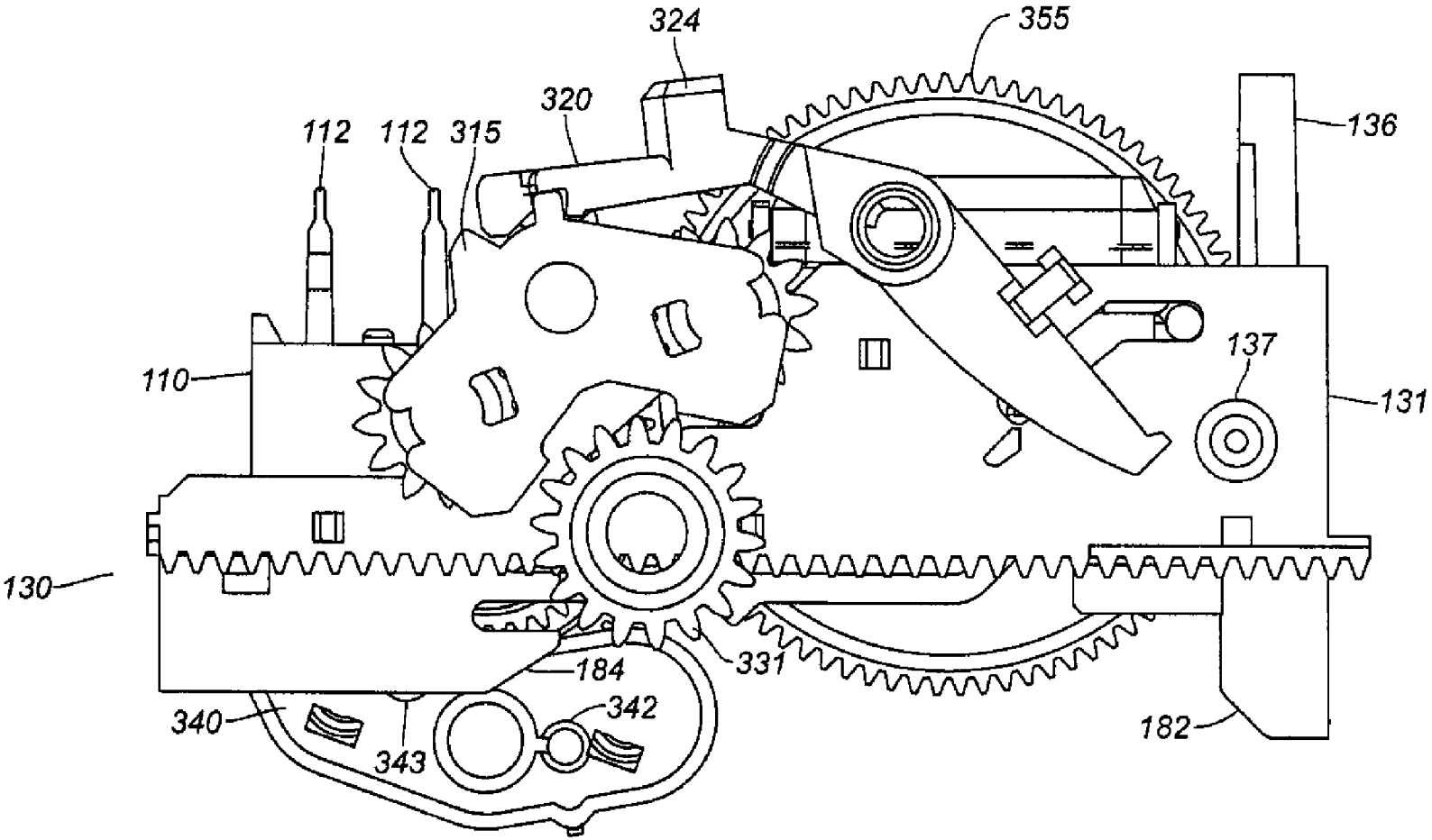
FIG. 16 is a right side view of an embodiment of the maintenance sled of the present invention.

Referring to FIGS. 3, 11, 12, and 13 we will now describe the motions of the maintenance station in response to motions of the feed roller 312 when the carriage 200 enters the home position and the latching clutch arm 320 is unlatched, the feed roller being turned forward or reverse by feed roller gear 311 which is engaged with the paper motor drive gear (not shown) that extends through hole 310. In this embodiment, when the feed roller 312 is turned in reverse (that is, opposite the forward direction 313 that would tend to move paper toward from exit direction 304 if paper were present), then feed roller pinion 314 will turn clockwise in the view seen in FIG. 11. This will cause pivot arm 315 to rotate clockwise such that first gear 317 on pivot arm 315 becomes engaged with pivot arm receiving gear 331 and causes it to rotate clockwise. Sled frame idler gear 332 thus rotates counterclockwise so that sled drive gear 330 rotates clockwise. As seen in FIGS. 12 and 13, first pinion 336 and second pinion 337 are mounted on sled rack pivot arm 334 (a portion of which is hidden in FIG.

12). Sled rack pivot arm 334, sled pivot arm idler gear 335, and sled drive gear 330 are all mounted on sled drive shaft 333, so that the above mentioned clockwise rotation of sled drive gear 330 (as viewed in FIG. 11) causes sled drive shaft 333 and sled rack pivot arm 334 to rotate, thus bringing first pinion 336 into engagement with the teeth of sled rack 150. Sled drive shaft 333 is rotationally mounted to maintenance station frame 160, but is fixed such that it cannot move translationally relative to the frame 160. Sled pivot arm idler gear 335 is driven in the same rotational sense as sled drive gear 330, so that both first pinion 336 and second pinion 337 are driven in the opposite rotational sense with respect to sled drive gear 330. As a result, the rotation of first pinion 336 will cause maintenance sled 130 to move forward in direction 154. Pins 137 on maintenance sled 130 travel along corresponding slots (not shown) in maintenance station frame 160 to help guide the linear motion of the sled. As maintenance sled 130 moves forward, the wiper blades 112 move across printhead nozzle face 252. After the wiper blades 112 pass the printhead nozzle face 252, the wiper blades are driven past the wiper scraper 162. The stationary wiper scraper 162 removes excess fluid from the moving and flexing wiper blades 112, by scraping and also by causing the wiper blades to flick the fluid inside the wiper scraper box 161 as the blades pass the wiper scraper 162 and flex back into their upright position. In addition, as described above, the continued forward motion of maintenance sled 130 causes the cap support platform 121 to hit forward stop 164, so that the cap support platform 121 is moved upward until cap sealing surface 122 seals against the printhead face. After the cap sealing surface 122 is sealed against the printhead face, the maintenance sled 130 has moved sufficiently such that first pinion 336 is located at the second end region 153 of rack 150. In second end region 153, there are no rack teeth that first pinion 336 is able to engage, so the driving force of the paper advance motor is disengaged from rack 150 and maintenance sled 130 is no longer driven forward even if feed roller 312 and sled drive gear 330 continue to turn.

Continued turning of feed roller 312 and sled drive gear 330 will also cause gear 338 to turn in the same rotational sense. As will be explained with reference to FIGS. 3, 14, 15, and 16, gear 338 supplies power to tube pump 170. Gear 338 is mounted on drive shaft 333, and gear 338 is also in contact with toggle arm 340, which is located outside maintenance station frame 160. Mounted on the outside surface of toggle arm 340 are first gear 344 of the pump gear train, second gear 346 of the pump gear train, and direction reversing gear 345. Toggle arm spring 341 is mounted on an extension of drive shaft 333 on the outside hub surface of gear 338. From the inside surface of toggle arm 340, both first pin 342 and second pin 344 extend through maintenance station frame 160. When maintenance sled 130 is moving forward, toggle arm 340 is constrained such that neither first gear 344 nor second gear 346 is able to engage with first member 351 of the compound gear.

As maintenance sled 130 moves into its fully forward position, such that the sealing surface 122 of the cap seals the printhead face and first pinion 336 is about to move out of contact with the rack teeth, a first contact surface 182 from maintenance sled 130 strikes first pin 342 on toggle arm 340. This causes toggle arm 340 to rotate about sled drive shaft 333 until first gear 344 is engaged with first member 351 of the compound gear. At about this same time, first pinion 336 advances into second end region 153 of rack 150 so that first pinion 336 is disengaged from rack 150. As the feed roller 312 continues to be rotated in the reverse direction, sled drive shaft gear 338 and first gear 344 rotate in that same sense, first gear 344 being connected to sled drive shaft gear 338 through direction reversing gear 345. This causes both first member 351 and second member 352 of the compound gear to rotate in direction 353, so that pump cam gear 355 rotates in direction 356.

The rotation of pump cam gear 355 in direction 356 causes a pumping action in tube pump 170 in the following way. Pump cam gear 355 is coaxially mounted with pump roller cam 173, so that pump roller cam also rotates in direction 356. Pin 172 of pump roller 171 thus rides along pump cam surface 174 toward compression portion 175 of the cam surface, and pump roller 171 gets increasingly close to compression rim 176. Flexible tubing (not shown) is thus compressed between pump roller 171 and compression rim 176. This reduction in internal volume of the flexible tubing results in a negative pressure within the tubing. Subsequent rotations of pump roller cam 173 cause repeated compressions of the flexible tubing and thereby an increase in the negative pressure, as is well known in the art. The amount of negative pressure can thus be controlled by the number of rotations of the feed roller 312, independent of any further movement of the rack 150 or the maintenance sled 130.

Disengagement of first pinion 336 from rack 150 also means that there is no extra drag on the paper advance motor, so that the full power can be applied to the pumping action. The flexible tubing (not shown) is connected to cap waste port 126 shown in FIG. 17. Cap waste port 126 is connected to cap suction slots 128 shown in FIG. 15, so that a negative pressure can be controllably provided within the cap in order to accomplish priming when the cap is sealed against the printhead face. Thus, once maintenance sled 130 is fully forward, the cap is sealingly engaged with the printhead and actuation of the pump is enabled for priming. It can be decided by the user or the control electronics (depending on operating conditions, for example) whether or not priming is required, or how much priming is required. If no priming is required, then the paper advance motor is stopped, so that feed roller 312 and sled drive gear stop, and no power is transmitted to the pump cam gear 355.

Figure 17:
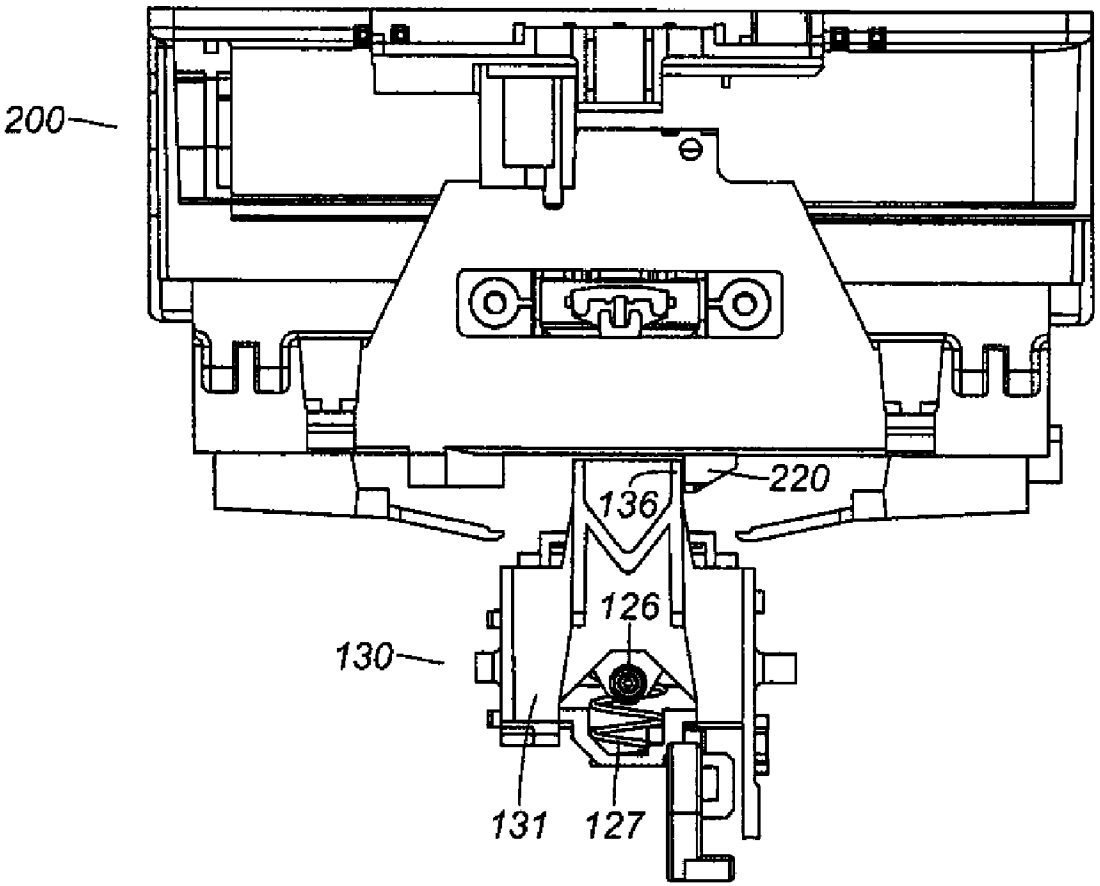
FIG. 17 is a rear view of an embodiment of the maintenance sled of the present invention.

Assisting in providing a reliable seal of the cap sealing surface 122 against the printhead face is cap spring mount 127 shown in FIG. 17. Also shown in FIG. 17 is carriage latch feature 136 which extends from the rear 131 of maintenance sled 130. When maintenance sled 130 is in its fully forward position and the printhead is capped, carriage latch feature 136 is positioned adjacent to extension 220 from carriage 200. Thus the carriage 200 is latched into the home position so that it cannot move along carriage guide rail 384, and damage to the printhead face or the cap by relative sliding motion are prevented.

Between printing jobs the paper advance motor and the carriage motor 380 are typically turned off, so that the printhead remains capped. During this time, depending on how long the interval is between printing jobs, the control electronics can cause the printhead to spit occasionally, i.e. to eject some droplets of liquid into the cap.

We next will describe the motions and maintenance operations which occur as the printhead is made ready to leave the home position, so it can begin printing. If it is decided that priming is required before the printhead leaves the cap, the paper advance motor is turned in reverse so that priming occurs as described above. Also, optionally the control electronics can cause the printhead to spit before leaving the cap. Then to retract the cap so that the printhead is no longer sealed, the paper advance motor is turned in the forward direction so that paper feed roller 312 rotates in forward direction 313. Because the carriage 200 is still in the home position, latching clutch arm 320 is still in the unlatched configuration of FIG. 11. Forward rotation of the feed roller 312 causes a counterclockwise rotation of feed roller pinion 314 and pivot arm 315 (from the view of FIG. 11), so that second gear 318 on pivot arm 315 is rotated into engagement with pivot arm receiving gear 331. Thus both pivot arm receiving gear 331 and sled drive gear 330 will be rotated counterclockwise from the view of FIG. 11. Such rotation of sled drive gear 330 will cause sled rack pivot arm 334 to rotate second pinion 337 into engagement with the rack teeth in second end region 153 of rack 150. Because of the offset rack configuration, even though first pinion 336 could no longer engage with rack 150 when the printhead is capped, second pinion 337 is still able to engage in second end region 153. Continued forward rotation of feed roller 312 will transmit power to second pinion 337 so that maintenance sled 130 moves opposite direction 154.

Using the terminology "back and forth" to describe the motions of maintenance sled 130, in this example we would identify "forth" as forward motion toward the front 308 of printer chassis 300, and we would identify "back" as backward motion toward the rear 309 of printer chassis 300. As the maintenance sled 130 begins to move back, the wiper blade platform 110 moves back with it. When the maintenance sled is back far enough that cap support platform 121 is no longer biased against forward stop 164, stretched spring 114 is released, so that its restoring force pulls capping support platform 121 downward along inclined slots 133 and 134, being guided by pins 123 and 124. Since maintenance sled 130 is moving back at the same time that capping support platform 121 is moving downward along the inclined slots, from the point of view of the stationary printhead face, the cap is retracted vertically downward, with no lateral movement of the cap sealing surface 122 across printhead nozzle face 252. The vertical downward movement of the capping support platform 121 causes a gap between the sealing surface 122 and the nozzle face 252. As maintenance sled 130 moves further back, the wiper blades 112 are pulled backward across wiper scraper 162 and then across printhead nozzle face 252. Excess fluid (for example, from priming) can thus be wiped from nozzle face 252. Continued movement back of maintenance sled 130 also causes second contact surface 184 to strike second pin 343 on toggle arm 340. This causes toggle arm 340 to rotate about sled drive shaft 333 until second gear 346 is engaged with first member 351 of the compound gear.

In the discussion above, when the feed roller 312 was moving in reverse and the printhead was capped, direction reversing gear 345 caused first gear 344 to rotate in the same direction as sled drive shaft gear 338. Because there is no direction reversing gear between sled drive shaft gear 338 and second gear 336, when feed roller 312 moves in forward direction 313 and the printhead is uncapped, first member of compound gear 351 is rotated again in direction 353, so that pump cam gear 355 is rotated again in direction 356 by second member 352 of the compound gear. Thus, whether rotating the feed roller 312 in reverse in the capped mode for priming, or rotating the feed roller 312 forward in direction 313 for emptying waste ink from the tank in the uncapped mode, proper rotation is applied to tube pump 170 for providing a negative pressure. As the second pinion 337 reaches first end region 151 of rack 150, there are no more rack teeth that it can engage, so power can be applied to the tube pump 170 as needed, without additional drag from the rack 150. The user or (more typically) the control electronics can decide whether it is necessary to empty the waste ink from the cap, and suction can be optionally applied by continued rotation of the feed roller 312 in the forward direction 313, or optionally can not be emptied, by stopping feed roller 312.

With the maintenance sled 130 having been moved back, carriage latch feature 136 is no longer positioned adjacent to the latch extension 220 from carriage 200. Thus the carriage motor can be turned on to move the carriage 200 out of the home position at this point, for example in order to do printing. As the carriage 200 leaves the home position, clutch pusher 210 is moved out of engagement with extension 324 of clutch arm 320. As a result, spring 321 causes clutch arm 320 to rotate in direction 323. If needed, a rotation of feed roller 312 will cause pivot arm 315 to rotate sufficiently that latching tab 316 of pivot arm 315 is again captured in latching notch 328 of clutch arm 320, so that neither first gear 317 nor second gear 318 on pivot arm 315 is able to transfer power to the maintenance station. Instead, as appropriate during printing, the power from the paper advance motor is applied to various rollers for moving paper or other print medium through the system.

When the printing is done and the printhead returns to the home position, after a suitable time, the capping procedure can be initiated again as described above. As it can be appreciated, at this point the maintenance sled 130 is in its fully back position so that second pinion 337 cannot be engaged with rack teeth in the first end region 151 of rack 150. However, when the feed roller is rotated in reverse direction, first pinion 336 is rotated into engagement with the teeth toward the edge of the rack in the first end region 151. Thus, the offset rack configuration plus the offset pinions 336 and 337 make it possible to accomplish all of the necessary motions for maintenance operations—and particularly for independent control of pumping for priming or emptying the cap—using motion from the paper advance motor as it is rotated in forward or reverse directions.

Figure 18:
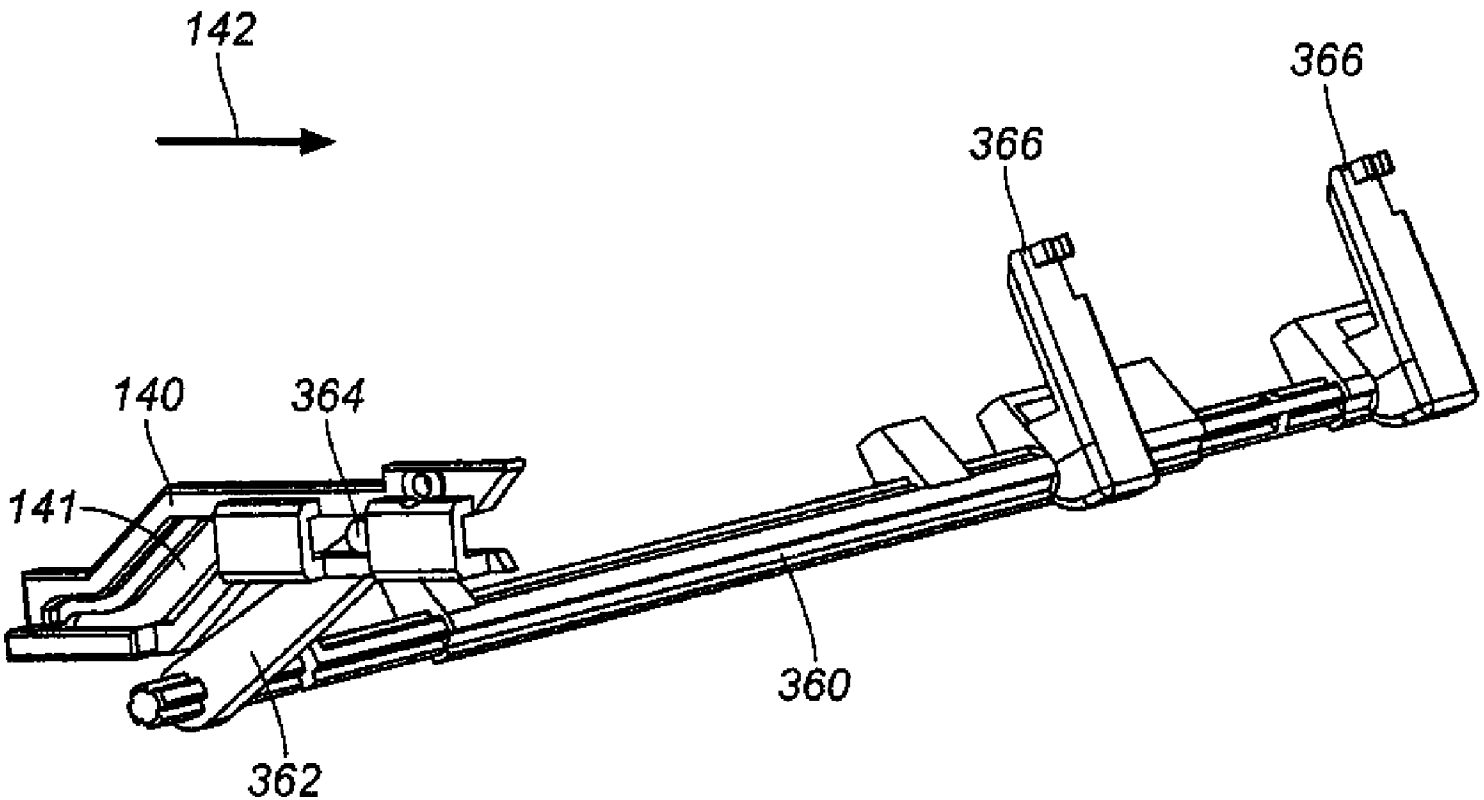
FIG. 18 is a perspective view of paper stoppers and an embodiment of the actuation mechanism of the present invention.
Figure 19:
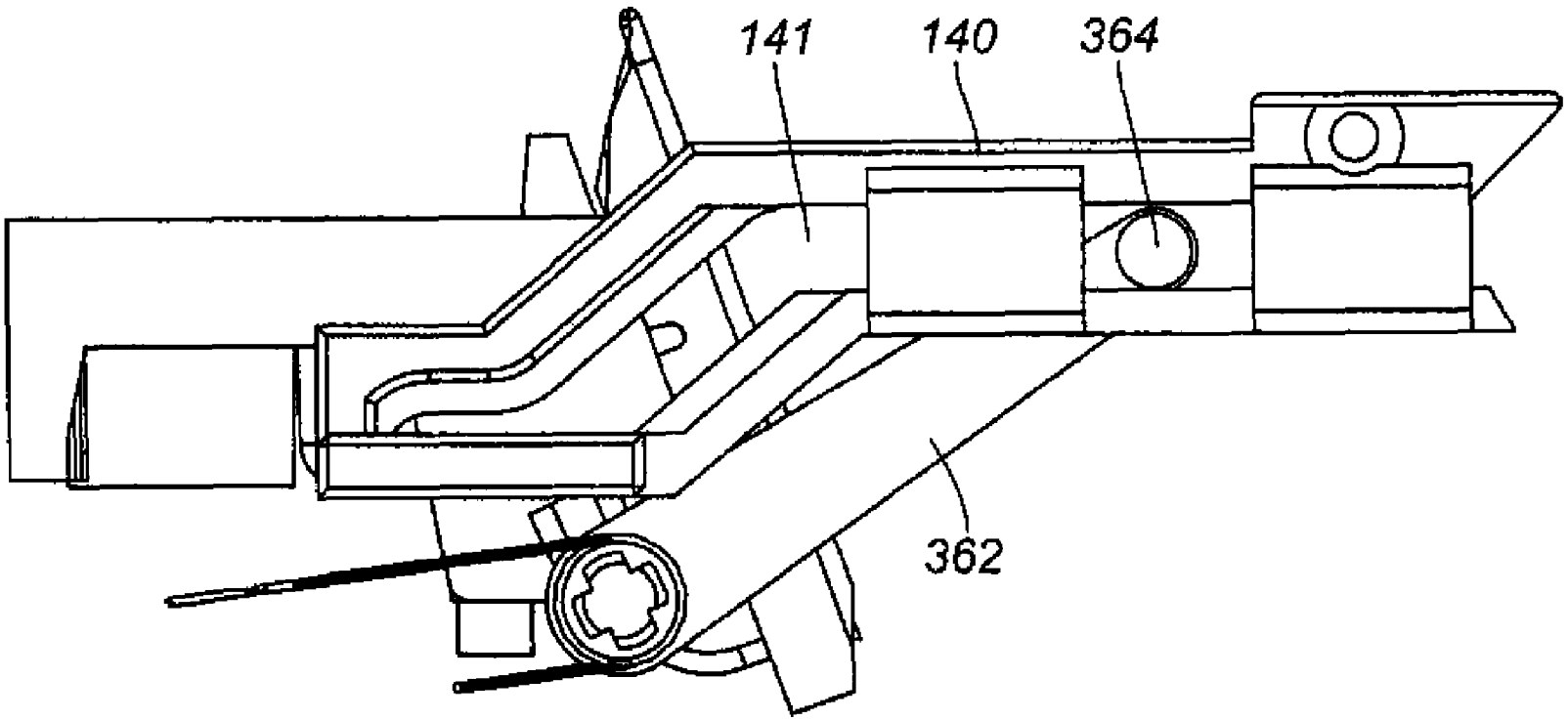
FIG. 19 is a right side view of a portion of the actuation mechanism of FIG. 18 with paper stoppers retracted for printing.
Figure 20:
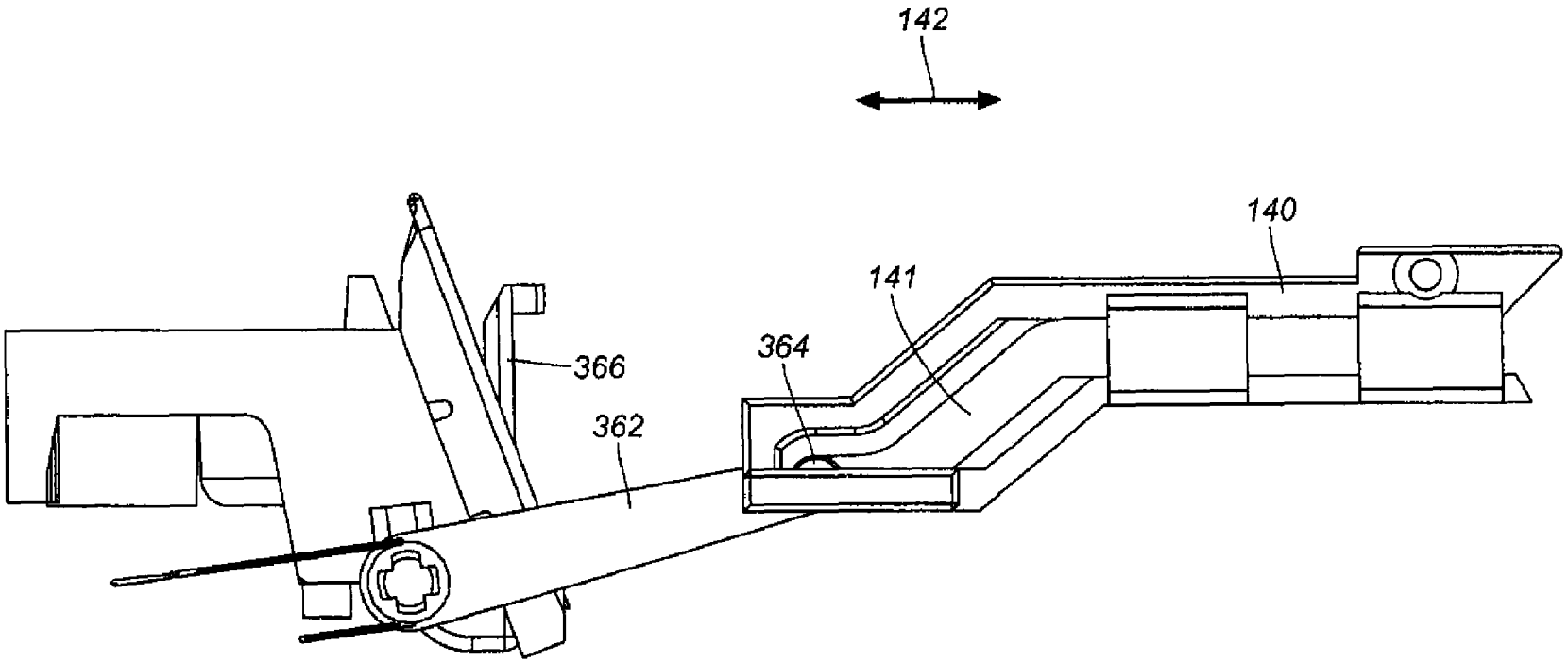
FIG. 20 is a right side view of a portion of the actuation mechanism of FIG. 18 with paper stoppers actuated for paper loading.

FIGS. 18, 19 and 20 illustrate one further operation (raising or lowering the paper stoppers) that is enabled in this embodiment. While this operation is enabled by motion of maintenance sled 130, raising and lowering of the paper stoppers is a paper handling operation rather than a maintenance operation. FIG. 18 shows paper stoppers (also called paper stopper arms) 366 mounted on rotatable paper stopper shaft 360. Also mounted on paper stopper shaft 360 is shaft arm 362 which includes shaft arm pin 364. Paper stopper shaft can be located toward the rear 309 of printer chassis 300 and can be mounted on the inside of the case (not shown) into which printer chassis 300 is mounted. As a stack of paper is loaded from the front 308 of printer chassis 300, it is desired to have the paper stoppers 366 rotated to their forward position, seen in FIG. 20. The front edges of the stack of paper can then be aligned against the paper stoppers. However, during printing it is desired to have the paper stoppers rotate back into a retracted position, so that they are less vertical (as in FIGS. 18 and 19) and are moved out of the way of paper advance. These rotations of the paper stoppers 366 are accomplished by motions of the maintenance sled 130 back and forth along bidirectional arrow 142, the back and forth motion occurring as described above in response to rotation forward or reverse of the paper feed roller 312 and engagement between first pinion 336 or second pinion 337 with offset rack 150. FIG. 7 shows a side view of the maintenance sled 130 in the back position for printing. Sled extension 140 moves with maintenance sled 130 and is to the right in FIG. 7. FIG. 8 shows a side view of the maintenance sled 130 after it has moved forth for capping of the printhead. Relative to FIG. 7, sled extension 140 is farther to the left in FIG. 8. Sled extension 140 includes ramped slot 141 (ramped at an angle relative to sled motion direction 154) in which shaft arm pin 364 is inserted, as shown in FIGS. 18, 19 and 20. When the maintenance sled 130 moves back into position for printing to occur as in FIG. 7, shaft arm pin 364 rides up the ramped slot 141 to the position seen in FIG. 19. Riding up the ramped slot 141 causes shaft arm 364 to be raised, so that paper stopper shaft 360 rotates about its axis in a direction causing paper stoppers 366 to retract. Thus, when maintenance sled 130 has moved into position for printing, it also brings paper stoppers 366 into position for printing. On the other hand, when maintenance sled 130 moves forth into the capping position as seen in FIG. 8, shaft arm pin 364 rides down ramped slot 141, causing shaft arm 362 to be lowered, so that paper stopper shaft 360 rotates about its axis to bring paper stoppers 366 forward into their actuated paper loading position shown in FIG. 20. Thus, when the maintenance sled 130 is in its capping position (and printing cannot occur), the paper stoppers are in position such that paper loading can occur.

The invention has been described with reference to a preferred embodiment; However, it will be appreciated that variations and modifications can be effected by a person of ordinary skill in the art without departing from the scope of the invention.

PARTS LIST

100 Maintenance station
110 Wiper blade platform
112 Wiper blades
114 Spring
120 Cap assembly
121 Cap support platform
122 Cap sealing surface
123 Cap platform front pin
124 Cap platform rear pin
126 Cap waste port
127 Cap spring mount
128 Cap suction slots
130 Maintenance sled
131 Rear of maintenance sled
133 Inclined slot for front pin of cap platform
134 Inclined slot for rear pin of cap platform
136 Carriage latch feature on sled
137 Sled guide pin
140 Sled extension
141 Ramped slot
142 Direction of motion to rotate paper stopper shaft
150 Sled rack
151 First end region of rack
152 Middle region of rack
153 Second end region of rack
154 Forward direction of sled motion (forth)
155 Length dimension of rack
160 Maintenance station frame
161 Wiper scraper box
162 Wiper scraper
164 Forward stop
170 Tube pump
171 Pump roller
172 Pump roller pin
173 Pump roller cam
174 Pump cam surface
175 Compression portion of cam surface
176 Compression rim
182 Sled contact surface for first pin
184 Sled contact surface for second pin
200 Carriage
210 Clutch pusher
220 Carriage latch extension
230 Carriage electrical connector
240 Carriage print zone region
250 Printhead chassis
251 Printhead die
252 Printhead nozzle face
253 Nozzle arrays
254 Nozzle array direction
255 Wire bond
256 Encapsulation
257 Flex circuit
258 Printhead electrical connector
259 Electrical leads
261 Substrate
262 Multichamber ink supply
264 Single chamber ink supply
270 Ink on nozzle face
300 Printer chassis
302 Paper load entry
303 Print region
304 Paper exit
306 Right side of printer chassis
307 Left side of printer chassis
308 Front of printer chassis
309 Rear of printer chassis
310 Hole for paper advance motor drive gear
311 Feed roller gear
312 Feed roller
313 Forward rotation of feed roller
314 Feed roller pinion
315 Latching pivot arm
316 Latching tab
317 First gear on latching pivot arm
318 Second gear on latching pivot arm
320 Latching clutch arm
321 Spring
322 Clutch arm mounting pin
323 Clutch arm rotation from spring
324 Clutch arm extension
325 Beveled surface
326 Clutch arm rotation from carriage push
328 Latching notch in clutch arm
330 Sled drive gear
331 Pivot arm receiving gear
332 Sled frame idler gear
333 Sled drive shaft
334 Sled rack pivot arm
335 Sled pivot arm idler gear
336 First pinion
337 Second pinion
338 Sled drive shaft gear to pump
340 Toggle arm for pump gear train
341 Toggle arm spring
342 Toggle arm first pin
343 Toggle arm second pin
344 First gear of pump gear train
345 Direction reversing gear
346 Second gear of pump gear train
351 First member of compound gear
352 Second member of compound gear
353 Compound gear rotation
355 Pump cam gear
356 Pump cam rotation
360 Paper stopper shaft
362 Shaft arm
364 Shaft arm pin
366 Paper stoppers

380 Carriage motor
382 Carriage rail
384 Belt
386 Rotation limiting rail
390 Printer electronics board
392 Cable connectors

The invention claimed is:

1. A printer comprising:

a feed roller shaft including an end; and a maintenance station disposed near the end of the feed roller shaft, the maintenance station comprising:

a first pinion;

a second pinion; and a maintenance sled including a rack, the rack including teeth positioned along a length dimension of the rack to provide a travel path for the maintenance sled, the first pinion engaging the rack teeth while the second pinion is disengaged from the rack teeth and the second pinion engaging the rack teeth while the first pinion is disengaged from the rack teeth being such that the maintenance sled travels back and forth, respectively, along the travel path depending upon whether the first pinion or the second pinion is engaged with the rack teeth.

2. The printer of claim 1, the rack of the maintenance sled including a first end region, a middle region, and a second end region as viewed along the length dimension, wherein the rack teeth in the first end region are offset from the rack teeth in the second end region as viewed in a direction that is parallel to the feed roller shaft.

3. The printer of claim 2, wherein the first pinion is engageable the rack teeth in the first end region and the middle region, but not with the rack teeth in the second end region, and the second pinion is engageable with the rack teeth in the second end region and the middle region, but not with the rack teeth in the first end region.

4. The printer of claim 1, the travel path being a first path, the maintenance sled further comprising:

a wiper blade platform including a wiper blade oriented parallel to the feed roller shaft, the wiper platform being moveable with the maintenance sled along the first path; and a cap assembly including a cap support platform, the cap support platform being sequentially movable along the first path, and along a second path that is perpendicular to the first path and perpendicular to the feed roller shaft.

5. The printer of claim 4, the maintenance sled further comprising a slot inclined at an angle relative to the first path;

the cap support platform further comprising a pin; and the maintenance station further comprising a frame including a member disposed to stop movement of the cap support platform along the first path, wherein the pin of the cap support platform is moveable along the inclined slot such that movement of the cap support platform along the second path occurs when the member of the frame is in contact with the cap support platform.

6. The printer of claim 1, the printer further comprising:

a pivoting gear assembly comprising:

a first gear;

a second gear; and a gear mounted coaxially on the feed roller shaft;

the maintenance station further comprising a frame, the frame including a gear assembly mounted thereto, wherein a gear of the gear assembly mounted to the frame is selectably engageable with the first gear or the second gear of the pivoting gear assembly.

7. The printer of claim 6, the pivoting gear assembly further comprising:

a latch, wherein the first gear and the second gear of the pivoting gear assembly are prevented from being engaged with the gear of the gear assembly mounted to the frame when the latch of the pivoting gear assembly is engaged.

8. The printer of claim 6, the pivoting gear assembly further comprising:

a latch, wherein the first gear of the pivoting gear assembly meshes with the gear of the gear assembly mounted on the frame when the latch is disengaged and when the feed roller shaft rotates in a first rotational direction, and wherein the second gear of the pivoting gear assembly meshes with the gear of the gear assembly mounted to the frame when the latch is disengaged and when the feed roller shaft rotates in a second rotational direction.

9. The printer of claim 6, the maintenance station further comprising:

a sled drive shaft rotationally mounted to the frame of the maintenance station, the sled drive shaft being rotated in conjunction with rotation of the gear of the gear assembly mounted on the frame.

10. The printer of claim 9, the sled drive shaft including a pivot arm on which the first pinion and the second pinion are mounted, wherein the first pinion is engageable with the rack teeth of the maintenance sled when the sled drive shaft is rotated in a first direction, and wherein the second pinion is engageable with the rack teeth of the maintenance sled when the sled drive shaft is rotated in a second direction.

11. The printer of claim 1, further comprising a paper stopper assembly comprising:

a rotatable shaft;

a paper stopper arm mounted on the rotatable shaft;

a shaft arm mounted on the rotatable shaft, the shaft arm including a pin; and the maintenance sled further comprising an extension including a slot positioned at an angle relative to the travel path, the slot being engageable with the pin of the shaft arm, wherein the motion of the pin in the slot causes the paper stopper arm to rotate to an actuated position as the maintenance sled moves forth, and wherein the motion of the pin in the slot causes the paper stopper arm to rotate to a retracted position as the maintenance sled moves back.

12. The printer of claim 1, the maintenance sled including a carriage locking structure, the printer further comprising:

a carriage guide disposed parallel to the feed roller shaft;

a carriage positioned to move along the carriage guide, the carriage including an extension adapted to prevent movement of the carriage along the carriage guide when the extension is in contact with the carriage locking structure of the maintenance sled.

13. The printer of claim 4, further comprising:

a carriage positioned to move in a direction parallel to feed roller guide shaft, the carriage further comprising:

a printhead including a nozzle face;

the cap assembly further comprising:

a sealing surface, wherein movement of the cap support platform along the second path toward the printhead causes the sealing surface to contact the printhead and seal an area around the nozzle face, and wherein movement of the cap support platform along the second path away from the printhead causes a gap between the sealing surface and the nozzle face.

14. The printer of claim 9, the maintenance station further comprising:

a tube pump including a pump roller cam and a gear that is coaxially mounted to the pump roller cam;

a toggling gear assembly mounted to the frame of the maintenance station, the toggling gear assembly including a first gear, a direction reversing gear, a second gear and a gear that is mounted coaxially on the sled drive shaft; and a compound gear including a first gear member and a second gear member, the first gear member being selectably engageable with either of the first gear or the second gear of the toggling gear assembly, the second gear member being engaged with the gear that is coaxially mounted to the pump roller cam, wherein actuation of the tube pump occurs regardless of a rotational direction of the sled drive shaft through the interaction of the first gear member of the compound gear and either of the second gear of the toggling gear assembly or the first gear and the direction reversing gear of the toggling gear assembly.

15. The printer of claim 14, the travel path being a first path, the printer further comprising:

a carriage positioned to move in a direction parallel to the feed roller shaft, the carriage further comprising:

a printhead including a nozzle face;

the toggling gear assembly further comprising:

a first pin and a second pin the maintenance sled further comprising:

a cap assembly including a cap support platform, the cap support platform being sequentially movable along the first path, and along a second path that is perpendicular to the first path and perpendicular to the feed roller shaft, the cap assembly further comprising a sealing surface, wherein movement of the cap support platform along the second path toward the printhead causes the sealing surface to contact the printhead and seal an area around the nozzle face, and wherein movement of the cap support platform along the second path away from the printhead causes a gap between the sealing surface and the nozzle face; and a first contact surface and a second contact surface, wherein when the sealing surface is in contact with the printhead, the first contact surface of the maintenance sled pushes the first pin on the toggling gear assembly to engage the first gear of the toggling gear assembly with the first gear member of the compound gear, and wherein the rack teeth of the maintenance sled are no longer engaged with the first pinion when the first gear of the toggling gear assembly is engaged with the first gear member of the compound gear.

16. The printer of claim 14, the travel path being a first path, the printer further comprising:

a carriage positioned to move in a direction parallel to the feed roller shaft, the carnage further comprising:

a printhead including a nozzle face;

the toggling gear assembly further comprising:

a first pin and a second pin the maintenance sled further comprising:

a cap assembly including a cap support platform, the cap support platform being sequentially movable along the first path, and along a second path that is perpendicular to the first path and perpendicular to the feed roller shaft, the cap assembly further comprising:

a sealing surface, wherein movement of the cap support platform along the second path toward the printhead causes the sealing surface to contact the printhead and seal an area around the nozzle face, and wherein movement of the cap support platform along the second path away from the printhead causes a gap between the sealing surface and the nozzle face; and a first contact surface and a second contact surface, wherein when the maintenance sled is moved back along the first path, the second contact surface of the maintenance sled pushes the second pin on the toggling gear assembly to engage the second gear of the toggling gear assembly with the first gear member of the compound gear, and wherein the rack teeth of the maintenance sled are no longer engaged with the second pinion when the second gear of the toggling gear assembly is engaged with the first gear member of the compound gear.

17. The printer of claim 1, wherein the travel path is perpendicular to the feed roller shaft.

18. The printer of claim 8, further comprising:

a carriage positioned to move in a direction parallel to feed roller shaft, wherein disengagement of the latch is caused by contact of the carriage with the latch.

* * * * *